US008810116B2

(12) United States Patent
Kasuya et al.

(10) Patent No.: US 8,810,116 B2
(45) Date of Patent: Aug. 19, 2014

(54) SPARK PLUG AND METHOD OF MANUFACTURING THE SAME

(75) Inventors: Yuji Kasuya, Tokyo (JP); Masahiro Inoue, Gifu (JP)

(73) Assignee: NGK Spark Plug Co., Ltd., Aichi (JP)

( * ) Notice: Subject to any disclaimer, the term of this patent is extended or adjusted under 35 U.S.C. 154(b) by 72 days.

(21) Appl. No.: 13/212,668

(22) Filed: Aug. 18, 2011

(65) Prior Publication Data

US 2012/0112619 A1 May 10, 2012

(30) Foreign Application Priority Data

Nov. 4, 2010 (JP) ..... 2010-247555

(51) Int. Cl.
*H01T 13/20* (2006.01)

(52) U.S. Cl.
USPC ..... 313/141; 445/7

(58) Field of Classification Search
USPC ..... 313/118–145; 445/7
See application file for complete search history.

(56) References Cited

U.S. PATENT DOCUMENTS

| | | | |
|---|---|---|---|
| 4,700,103 | A | 10/1987 | Yamaguchi et al. |
| 6,346,766 | B1 | 2/2002 | Kanao et al. |
| 6,700,317 | B2 | 3/2004 | Kanao et al. |
| 7,084,558 | B2 | 8/2006 | Teramura et al. |
| 7,150,252 | B2 | 12/2006 | Sugiyama et al. |
| 7,321,187 | B2 | 1/2008 | Teramura et al. |
| 2001/0030495 | A1* | 10/2001 | Kanao et al. ..... 313/141 |
| 2004/0041506 | A1 | 3/2004 | Teramura et al. |
| 2006/0213474 | A1 | 9/2006 | Sugiyama et al. |
| 2006/0238092 | A1 | 10/2006 | Teramura et al. |
| 2012/0019120 | A1 | 1/2012 | Nakayama et al. |

FOREIGN PATENT DOCUMENTS

| | | | |
|---|---|---|---|
| JP | 61-171080 | A | 8/1986 |
| JP | 62-100965 | A | 5/1987 |
| JP | 5-36462 | A | 2/1993 |
| JP | 2000-277231 | A | 10/2000 |
| JP | 2001-284012 | A | 10/2001 |
| JP | 2004-079507 | A | 3/2004 |
| JP | 2004-127916 | A | 4/2004 |
| JP | 2006-302867 | A | 11/2006 |
| JP | 2010-238498 | A | 10/2010 |

OTHER PUBLICATIONS

Japanese Office Action dated Jan. 29, 2013 for corresponding Japanese Patent Application No. 2010-247555.
Japanese Office Action dated Sep. 4, 2012 in corresponding Japanese Patent Application No. JP 2010-247555.

* cited by examiner

*Primary Examiner* — Andrew Coughlin
(74) *Attorney, Agent, or Firm* — Sughrue Mion, PLLC

(57) ABSTRACT

A buried portion (32B) buried from a junction target surface of a ground electrode (27) is provided in a noble metal tip (32). In a section, perpendicular to a central axis CL2 of the ground electrode (27), a large width portion (32W) is formed in the buried portion (32B), and a region between the junction target surface and a largest width region of the large width portion (32W) is formed into a shape which gradually increases in width, or into a shape having a region of the relevant shape and a constant width region. A region from the large width portion (32W) to a point of intersection P1, P2 is covered with a base material of the ground electrode (27) and a melt portion (35), and a thickness t1 (mm) of the noble metal tip (32) and a buried amount t2 (mm) satisfy 0.25≤t2/t1.

12 Claims, 16 Drawing Sheets

SPARK PLUG AND METHOD OF MANUFACTURING THE SAME

TECHNICAL FIELD

The present invention relates to a spark plug used in an internal combustion engine, or the like, and a method of manufacturing the same.

BACKGROUND ART

A spark plug used in a combustion device such as an internal combustion engine includes, for example, a center electrode extending in a direction of the axis, an insulating body provided on the outer periphery of the center electrode, a hollow cylindrical metal shell mounted on the outer side of the insulating body, and a ground electrode whose proximal end portion is joined to the leading end portion of the metal shell. The ground electrode is disposed with an approximately intermediate portion thereof bent back in such a way that the leading end portion thereof is opposed to the leading end portion of the center electrode, thereby forming a spark discharge gap between the leading end portion of the center electrode and the leading end portion of the ground electrode.

Also, a technology is known whereby a noble metal tip is provided in a region of the leading end portion of the ground electrode which forms the spark discharge gap, thus improving wear resistance and ignitability. In general, the noble metal tip is provided by an end face thereof being joined to the ground electrode by, for example, a resistance welding.

However, as the ground electrode is disposed protruding to the center side of a combustion chamber, the ground electrode is liable to become high in temperature, and the noble metal tip joined to the ground electrode is liable to become higher in temperature. Furthermore, with a recent high-powered and high-compression engine, the interior of the combustion chamber is liable to become still higher in temperature, and vibrations applied to the ground electrode and noble metal tip along with an operation of the engine are also liable to become larger. For this reason, there is fear that an oxidized scale grows quickly in a junction portion of the ground electrode and noble metal tip, and that the noble metal tip drops off from the ground electrode due to a large impact being applied along with vibrations or the like.

Therefore, a technique has been proposed whereby, in order to prevent the noble metal tip dropping off, as well as an end portion of the noble metal tip being buried into the ground electrode, the buried portion of the noble metal tip is provided with a flanged protruding portion or a constricted portion with a smaller diameter than the rest of the buried portion, thereby improving the strength of junction of the noble metal tip to the ground electrode (for example, refer to Patent Documents 1 and 2 or the like).

RELATED ART DOCUMENTS

Patent Documents

[Patent Document 1] JP-A-2001-284012
[Patent Document 2] JP-A-2004-79507

SUMMARY OF THE INVENTION

Problems that the Invention is to Solve

However, with the heretofore described technique, when burying the noble metal tip into the ground electrode, a space is liable to be formed between a side surface of the noble metal tip and the ground electrode due to the existence of the protruding portion or constricted portion. Consequently, it not being possible to secure a sufficient area of contact between the noble metal tip and ground electrode, there is fear that it is not possible to sufficiently improve the strength of junction. Once a space has been formed between the noble metal tip and ground electrode, oxygen becomes liable to infiltrate into the junction portion of the two, and there is a fear of a quick oxidized scale growth in the junction portion and thus a quick decrease in the strength of junction. Furthermore, when air remains in the space, the residual air expands at a high temperature when using the spark plug, and there is fear that this leads to damage to the junction portion.

The invention, having been contrived bearing in mind the heretofore described circumstances, has an object of providing a spark plug, and a method of manufacturing the same, with which it is possible to dramatically improve the strength of junction of a noble metal tip to a ground electrode, and it is possible to effectively prevent the noble metal tip dropping off.

Means for Solving the Problems

Hereafter, an itemized description will be given of each configuration suitable for achieving the object. Working effects specific to the corresponding configurations are quoted as necessary.

Configuration 1. A spark plug of this configuration is characterized by including an insulating body having an axial hole passing therethrough in a direction of an axis;

a center electrode inserted in the axial hole;

a hollow cylindrical metal shell provided on the outer periphery of the insulating body;

a ground electrode disposed at the leading end portion of the metal shell; and a columnar noble metal tip, joined to the leading end portion of the ground electrode, of which one end portion forms a gap with the leading end portion of the center electrode, wherein a buried portion buried into the interior side of the ground electrode from a junction target surface which is a surface of the ground electrode on the side on which the noble metal tip is joined is provided in the other end portion of the noble metal tip, and in a section, perpendicular to a central axis of the ground electrode, which passes through a center of a junction portion of the ground electrode and another end face of the noble metal tip, a large width portion larger in width than the one end portion of the noble metal tip is formed in the buried portion, a region of the noble metal tip positioned between the junction target surface and a largest width region of the large width portion is formed into a shape such as to gradually increase in width from one end side toward the other end side of the noble metal tip, or a shape such as to have a region gradually increasing in width, and a region constant in width, from the one end side toward the other end side of the noble metal tip, a region, of either side surface connecting the one end face and other end face of the noble metal tip, from the large width portion to a point of intersection with an extended line wherein the external line of the junction target surface is extended to the noble metal tip side is covered with at least one of a melt portion wherein the noble metal tip and ground electrode melt together and a base material of the ground electrode, and when a thickness of the noble metal tip along a central axis of the noble metal tip is taken to be t1 (mm), and an amount of the noble metal tip buried from the junction target surface along the central axis of the noble metal tip is taken to be t2 (mm), $0.25 \leq t2/t1$ is satisfied.

The "junction target surface" refers to a place, on a surface of the ground electrode to which the noble metal tip is joined, in which there occurs no change in shape, or the like, accompanying the burying of the noble metal tip and the formation of the melt portion. Also, the "center of the junction portion of the ground electrode and the other end face of the noble metal tip" means the center of gravity of the junction surface of the two.

According to the configuration 1, a region of the noble metal tip positioned between the junction target surface of the ground electrode and the largest width region of the large width portion is formed into a shape such as to gradually increase in width from one end side toward the other end side of the noble metal tip, or a shape such as to have a region gradually increasing in width, and a region constant in width, from the one end side toward the other end side of the noble metal tip. Consequently, it is possible to prevent a space being formed between the side surfaces of the noble metal tip and the ground electrode when burying the noble metal tip into the ground electrode, and it is possible to secure a sufficient area of contact between the two. Also, by it being possible to suppress the formation of the space, it is possible to suppress an infiltration of oxygen into the junction portion of the noble metal tip and ground electrode.

Furthermore, the large width portion larger in width than the one end portion of the noble metal tip is formed in at least a central position, in a longitudinal direction of the ground electrode, of the region of the noble metal tip joined to the ground electrode (that is, in the section, perpendicular to the central axis of the ground electrode, which passes through the center of the junction portion of the ground electrode and the other end face of the noble metal tip). Then, in the section, when the thickness of the noble metal tip along the central axis of the noble metal tip is taken to be t1 (mm), and the amount of the noble metal tip buried from the junction target surface along the central axis of the noble metal tip is taken to be t2 (ram), a configuration is adopted such that $0.25 \leq t2/t1$ is satisfied. That is, according to the configuration 1, a configuration is adopted such that the large width portion of the noble metal tip is formed into a shape such as to be retained in the ground electrode, and also, a region of the ground electrode retained by the large width portion is sufficiently thick-walled owing to the buried amount of the noble metal tip being sufficiently increased to such an extent as to satisfy $0.25 \leq t2/t1$. Because of this, it is possible to more reliably increase the force of retention of the noble metal tip in the ground electrode.

In addition, according to the configuration 1, in the heretofore described section, the region, of either side surface of the noble metal tip, from the large width portion to the point of intersection between the either side surface and the extended line wherein the external line of the junction target surface is extended to the noble metal tip side, is covered with the melt portion and the base material of the ground electrode. Consequently, as well as it being possible to suppress the formation of the space between the noble metal tip and ground electrode, it is possible to more effectively suppress an infiltration of oxygen between the two.

As above, according to the configuration 1, it is possible to dramatically improve the strength of junction of the noble metal tip to the ground electrode by increasing the force of retention of the large width portion in the ground electrode while securing a sufficient area of contact between the noble metal tip and ground electrode. Also, it is possible to suppress an oxidized scale growth by covering the region between either side surface of the noble metal tip and the ground electrode with the melt portion and the base material of the ground electrode, while suppressing the formation of the space between the noble metal tip and ground electrode, and it is thus possible to maintain a superior strength of junction over a long period. As a result of this, it is possible to effectively prevent the noble metal tip dropping off.

Configuration 2. According to this configuration, the spark plug of the configuration 1 is characterized in that in the heretofore described section, when a protrusion length of the large width portion, in a direction perpendicular to the central axis of the noble metal tip, positioned on one side surface side of the noble metal tip, with the point of intersection between one side surface of both side surfaces connecting the one end face and other end face of the noble metal tip and the extended line wherein the external line of the junction target surface is extended to the noble metal tip side as a reference, is taken to be $\alpha$ (mm), a protrusion length of the large width portion, in a direction perpendicular to the central axis of the noble metal tip, positioned on the other side surface side of the noble metal tip, with the point of intersection between the other side surface of the noble metal tip and the extended line wherein the external line of the junction target surface is extended to the noble metal tip side as a reference, is taken to be $\beta$ (mm), the protrusion length $\alpha$ or protrusion length $\beta$, whichever is larger, is taken to be x (mm), and the width of a largest width region of the large width portion in a direction perpendicular to the central axis of the noble metal tip is taken to be W1 (mm), $x \geq W1 \times 0.02$ is satisfied.

According to the configuration 2, it is possible to secure a sufficiently large distance from a place into which oxygen infiltrates (a boundary portion between the noble metal tip and the melt portion and ground electrode) to the junction portion of the other end face of the noble metal tip and the ground electrode (a portion particularly important for a firm junction of the noble metal tip and ground electrode). Consequently, it is possible to effectively suppress an infiltration of oxygen into the junction portion, and it is possible to further improve the strength of junction of the noble metal tip.

Configuration 3. According to this configuration, the spark plug of the configuration 1 or 2 is characterized in that the noble metal tip is joined to the ground electrode by the melt portion wherein the noble metal tip and ground electrode melt together, and in the heretofore described section, the melt portion is formed thrusting into the interior side of the ground electrode from the junction target surface, and when a distance along the central axis of the noble metal tip from the junction target surface to a region of the melt portion thrusting deepest into the interior side of the ground electrode is taken to be d1 (mm), $d1 \geq 0.06$ is satisfied.

According to the configuration 3, a portion of contact between the noble metal tip and ground electrode is covered with the sufficiently thick-walled melt portion. Consequently, it is possible to still further suppress an infiltration of oxygen into the junction portion of the noble metal tip and ground electrode, and it is possible to further improve the strength of junction.

Configuration 4. According to this configuration, the spark plug of the configuration 3 is characterized in that in the heretofore described section, when a largest width, in a direction perpendicular to the central axis of the noble metal tip, of a region of the melt portion thrusting into the interior side of the ground electrode from the junction target surface is taken to be Y (mm), $0.17 \leq Y \leq 0.27$ is satisfied.

According to the configuration 4, the largest width Y of the region of the melt portion thrusting into the interior side of the ground electrode is set to 0.17 mm or more, and a configuration is adopted such that the portion of contact between the noble metal tip and ground electrode is covered with the melt portion having a sufficient volume. Consequently, it is possible to more reliably suppress an infiltration of oxygen into the junction portion of the noble metal tip and ground electrode, and it is possible to further improve the strength of junction.

Meanwhile, when the volume of the melt portion is increased to excess, spark discharges become liable to occur between the center electrode and melt portion. Consequently, a spark hitting position is not stable, and there is fear that the effect of improving ignitability by providing the noble metal tip is not sufficiently achieved.

In this regard, according to the configuration 4, the largest width Y is set to 0.27 mm or less, preventing an excessive increase in volume of the melt portion. Consequently, it is possible to more reliably generate spark discharges between the center electrode and noble metal tip, and it is possible to more reliably achieve the effect of improving ignitability by providing the noble metal tip.

Configuration 5. According to this configuration, the spark plug of any one of the configurations 1 to 4 is characterized in that the noble metal tip is joined to the ground electrode by the melt portion wherein the noble metal tip and ground electrode melt together, and in the heretofore described section, the melt portion is in contact with at least one side surface of the two side surfaces connecting the one end face and other end face of the noble metal tip and the ground electrode positioned on the one side surface side.

According to the configuration 5, the melt portion is formed in such away as to be in contact with at least one side surface of the noble metal tip and the ground electrode. Consequently, it is possible to more reliably suppress an infiltration of oxygen into the junction portion of the noble metal tip and ground electrode, and it is possible to further improve the strength of junction.

Configuration 6. According to this configuration, the spark plug of any one of the configurations 1 to 5 is characterized in that the noble metal tip is joined to the ground electrode by the melt portion wherein the noble metal tip and ground electrode melt together, and in the heretofore described section, the melt portion, as well as being in contact with one side surface of the noble metal tip and the ground electrode positioned on the one side surface side, is in contact with the other side surface of the noble metal tip and the ground electrode on the other side surface side.

According to the configuration 6, the melt portion is formed in such a way as to be in contact with both side surfaces of the noble metal tip and the ground electrode. Because of this, it is possible to more effectively suppress an infiltration of oxygen into the junction portion of the noble metal tip and ground electrode, and it is possible to further improve the strength of junction.

Configuration 7. According to this configuration, the spark plug of the configuration 6 is characterized in that in the heretofore described section, when a distance, along the central axis of the noble metal tip, of a region of the melt portion in contact with one side surface of the noble metal tip, or a distance, along the central axis of the noble metal tip, of a region of the melt portion in contact with the other side surface of the noble metal tip, whichever is larger, is taken to be $d2$ (mm), $d2 \geq 0.20$ is satisfied.

According to the configuration 7, the area of contact between the side surfaces of the noble metal tip and the melt portion is sufficiently large. Consequently, it is possible to more reliably suppress an infiltration of oxygen into the junction portion of the noble metal tip and ground electrode.

Configuration 8. According to this configuration, the spark plug of any one of the configurations 3 to 7 is characterized in that in the heretofore described section, when a largest protrusion length of the melt portion from the junction target surface along the central axis of the noble metal tip is taken to be $d3$ (mm), $d3 \leq t1 - t2$ is satisfied.

According to the configuration 8, the largest protrusion length $d3$ is set to be equal to or smaller than the protrusion length ($t1 - t2$) of the noble metal tip from the junction target surface of the ground electrode. Consequently, it is possible to further suppress an occurrence of spark discharges between the center electrode and melt portion, and it is possible to more reliably generate spark discharges between the center electrode and noble metal tip. As a result of this, it is possible to more reliably achieve the effect of improving ignitability by providing the noble metal tip.

Configuration 9. According to this configuration, the spark plug of any one of the configurations 1 to 8 is characterized in that the noble metal tip is joined to the ground electrode by the melt portion wherein the noble metal tip and ground electrode melt together, and when seen from the one end face side of the noble metal tip, within a range, in a longitudinal direction of the ground electrode, corresponding to the junction portion of the ground electrode and the other end face of the noble metal tip, a length of the melt portion in the longitudinal direction of the ground electrode is equal to or larger than half a length of the junction portion in the longitudinal direction of the ground electrode.

According to the configuration 9, the melt portion having a sufficient length is formed in such a way as to cover the portion of contact between the noble metal tip and ground electrode. Consequently, it is possible to more effectively suppress an infiltration of oxygen into the junction portion of the two, and it is possible to further improve the strength of junction.

Configuration 10. According to this configuration, the spark plug of any one of the configurations 1 to 9 is characterized in that in the heretofore described section, the other end face of the noble metal tip is formed into a curved shape convex toward the interior side of the ground electrode.

According to the configuration 10, it is possible to increase the area of the junction portion of the other end face of the noble metal tip and the ground electrode, which is particularly important for a firm junction of the noble metal tip and ground electrode, and it is possible to further increase the strength of junction of the noble metal tip. Also, by achieving the increase in the area of junction, the strength of junction of the noble metal tip to the ground electrode decreases very little even though some oxidized scales appear in the junction portion, and it is possible to maintain a superior strength of junction.

Configuration 11. According to this configuration, the spark plug of any one of the configurations 1 to 10 is characterized in that the noble metal tip protrudes from the leading end face of the ground electrode.

According to the configuration 11, the noble metal tip is provided so as to protrude from the leading end face of the ground electrode. Consequently, the ground electrode is further distanced from the gap formed between the center electrode and noble metal tip, and it is possible to suppress a flame kernel growth inhibition due to the existence of the ground electrode. As a result of this, it is possible to further improve ignitability.

Meanwhile, when the noble metal tip is provided so as to protrude from the ground electrode, the noble metal tip becomes higher in temperature when the spark plug is used, meaning that there is more fear that the noble metal tip drops off, but by adopting the configuration 1 or the like, it is possible to eliminate the fear. In other words, the configuration 1 or the like is particularly significant when the noble metal tip is provided so as to protrude from the leading end face of the ground electrode in order to improve ignitability.

Configuration 12. According to this configuration, the spark plug of the configuration 11 is characterized in that $t2/t1 \leq 0.70$ is satisfied.

According to the configuration 12, a configuration is adopted such that the buried amount t2 of the noble metal tip does not become excessively large with respect to the thickness t1 of the noble metal tip, and a large amount of the noble metal tip is secured protruding from the junction target surface of the ground electrode. Consequently, it is possible to further distance the ground electrode from the gap formed between the center electrode and noble metal tip, and it is possible to still further suppress a flame kernel growth inhibition due to the ground electrode. As a result of this, it is possible to further improve ignitability.

Configuration 13. According to this configuration, a method of manufacturing the spark plug of any one of the configurations 1 to 12 is characterized by including a junction step of joining the noble metal tip to the ground electrode, wherein in the junction step, after the noble metal tip with a rectangular cross-sectional shape in a section including the central axis thereof is placed on the ground electrode, the noble metal tip is joined to the ground electrode while the buried portion buried into the ground electrode and the large width portion larger in width than the one end portion of the noble metal tip are being formed in the noble metal tip by the noble metal tip being energized while being pressed to the ground electrode side.

According to the configuration 13, in the junction step, the noble metal tip of rectangular cross section (for example, rectangular parallelepiped shape or cylindrical shape) in which the large width portion is not formed is heated by energization while being pressed against the ground electrode. Consequently, an angled portion of the other end portion of the noble metal tip and the vicinity thereof, which are comparatively likely to change in shape, are increased in width in the course of being buried into the ground electrode. That is, according to the configuration 13, it is possible to join the noble metal tip to the ground electrode while easily forming the large width portion on the other end side of the noble metal tip without performing a particular process on the noble metal tip.

BRIEF DESCRIPTION OF THE DRAWINGS

FIGS. 3(*a*) and (*b*) are enlarged sectional schematic views of a ground electrode, a noble metal tip, and the like.

FIG. 6 is an enlarged plan schematic view of the ground electrode, melt portion, and the like.

MODES FOR CARRYING OUT THE INVENTION

Figure 1:
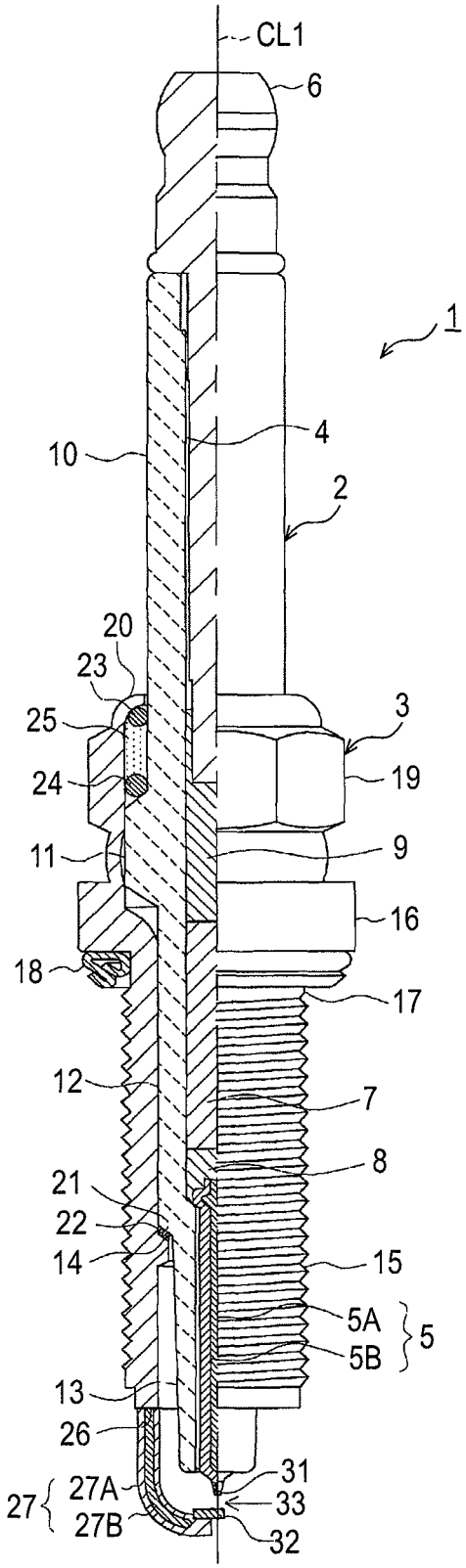
FIG. 1 is a partially sectioned front view showing a configuration of a spark plug.

Hereafter, a description will be given of one embodiment, while referring to the drawings. FIG. 1 is a partially sectioned front view showing a spark plug 1. In FIG. 1, a description will be given with a direction of an axis CL1 of the spark plug 1 as an up-down direction in the drawing, the lower side as the leading end side of the spark plug 1, and the upper side as the rear end side.

The spark plug 1 is configured of an insulator 2 acting as a hollow cylindrical insulating body, a hollow cylindrical metal shell 3 which holds the insulator 2, and the like.

The insulator 2, being formed by sintering alumina or the like, as is well known, includes in the external portion thereof a rear end side barrel portion 10 formed on the rear end side, a large diameter portion 11 formed closer to the leading end side than the rear end side barrel portion 10 so as to protrude outward in a radial direction, a middle barrel portion 12 formed closer to the leading end side than the large diameter portion 11 so as to be smaller in diameter than the large diameter portion 11, and an insulator nose length portion 13 formed closer to the leading end side than the middle barrel portion 12 so as to be smaller in diameter than the middle barrel portion 12. In addition, the large diameter portion 11, the middle barrel portion 12, and the larger proportion of the insulator nose length portion 13, of the insulator 2 are housed inside the metal shell 3. Then, a tapered shoulder 14 is formed at the junction of the middle barrel portion 12 and insulator nose length portion 13, and the insulator 2 is retained on the metal shell 3 by the shoulder 14.

Furthermore, an axial hole 4 is formed in the insulator 2 along the axis CL1 so as to pass through the insulator 2, and a center electrode 5 is inserted and fixed on the leading end side of the axial hole 4. The center electrode 5 is configured of an inner layer 5A formed from copper, a copper alloy, or the like, with superior thermal conductivity and an outer layer 5B formed from an Ni alloy with nickel (Ni) as a primary component. Furthermore, the center electrode 5 is formed in a bar-like (cylindrical) shape as a whole, and the leading end face thereof, as well as being formed to be planar, protrudes from the leading end of the insulator 2. Also, a cylindrical noble metal portion 31 formed from a predetermined noble metal alloy (for example, a platinum alloy or an iridium alloy) is provided at the leading end portion of the center electrode 5.

Also, a terminal electrode 6 is inserted and fixed on the rear end side of the axial hole 4 in a condition in which it protrudes from the rear end of the insulator 2.

Furthermore, a cylindrical resistor 7 is disposed between the center electrode 5 and terminal electrode 6 in the axial hole 4. Both end portions of the resistor 7 are electrically connected to the center electrode 5 and terminal electrode 6 via electrically conductive glass seal layers 8 and 9 respectively.

In addition, the metal shell 3 is formed in a hollow cylindrical shape from a metal such as a low carbon steel, and a thread portion (a male thread portion) 15 for mounting the spark plug 1 in a mounting hole of a combustion device (for example, an internal combustion engine or a fuel cell reformer) is formed on the outer peripheral surface of the metal shell 3. Also, a seat 16 is formed on the rear end side outer peripheral surface of the thread portion 15, and a ring-like gasket 18 is fitted over a thread neck 17 at the rear end of the thread portion 15. Furthermore, a tool engagement portion 19 of hexagonal cross section for engaging a tool such as a wrench when mounting the metal shell 3 in the combustion device is provided, as well as a caulked portion 20 for holding the insulator 2 at the rear end portion being provided, on the rear end side of the metal shell 3.

Also, a tapered shoulder 21 for retaining the insulator 2 is provided on the inner peripheral surface of the metal shell 3. Then, the insulator 2 is inserted from the rear end side toward the leading end side of the metal shell 3, and fixed to the metal shell 3 by caulking a rear end side opening portion of the metal shell 3 inward in the radial direction, that is, forming the caulked portion 20, in a condition in which the shoulder 14 of the insulator 2 is retained in the shoulder 21 of the metal shell 3. An annular plate packing 22 is interposed between the shoulders 14 and 21 of both the insulator 2 and metal shell 3. Because of this, the interior of a combustion chamber is maintained airtight, thus preventing a fuel gas infiltrating into a space between the insulator 2 nose length portion 13 and metal shell 3 inner peripheral surface exposed to the interior of the combustion chamber from leaking to the exterior.

Furthermore, in order to make a caulking seal more complete, annular ring members 23 and 24 are interposed between the metal shell 3 and insulator 2 on the rear end side of the metal shell 3, and a space between the ring members 23 and 24 is filled with talc 25 powder. That is, the metal shell 3 holds the insulator 2 across the plate packing 22, ring members 23 and 24, and talc 25.

Figure 2:
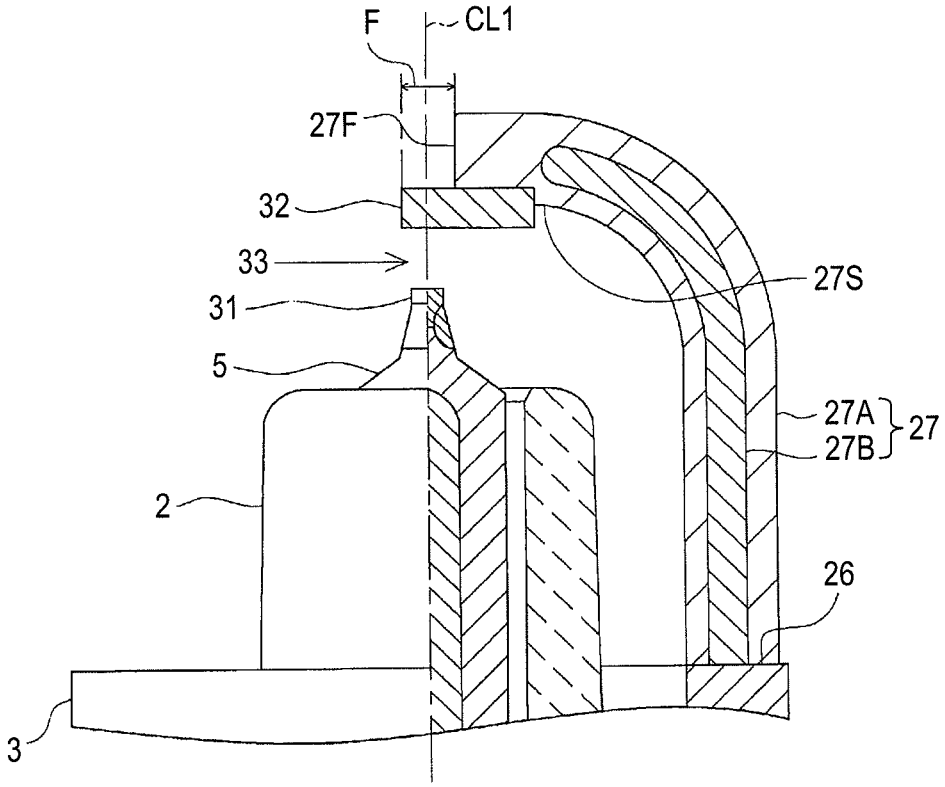
FIG. 2 is a partially sectioned enlarged front view showing a configuration of the leading end portion of the spark plug.

Also, as shown in FIG. 2, a ground electrode 27 which is bent back to the center electrode 5 side in an approximately intermediate portion of the ground electrode 27, forming a rectangular cross section, is joined to a leading end portion 26 of the metal shell 3. The ground electrode 27 is configured of an outer layer 27A formed by an Ni alloy [for example, Inconel 600 or Inconel 601 (both are registered trademarks)] and an inner layer 27B formed by a copper alloy, pure copper, or the like, which is a metal with better pyroconductivity than the Ni alloy.

A noble metal tip 32 formed from a predetermined noble metal (for example, iridium or platinum) or a noble metal alloy with a noble metal as a primary component is joined to a leading end side side surface 27S (corresponding to a "junction target surface") which is a surface of the ground electrode 27 positioned on the center electrode 5 side. The noble metal tip 32 is such that one portion thereof protrudes a predetermined protrusion amount F (for example, 0.5 mm or more and 0.75 mm or less) from a leading end face 27F of the ground electrode 27. Then, a spark discharge gap 33 acting as a gap is formed between one end face of the noble metal tip 32 and the center electrode 5 (noble metal portion 31), and a spark discharge is carried out in a direction along the axis CL1 in the spark discharge gap 33.

Figure 3A:
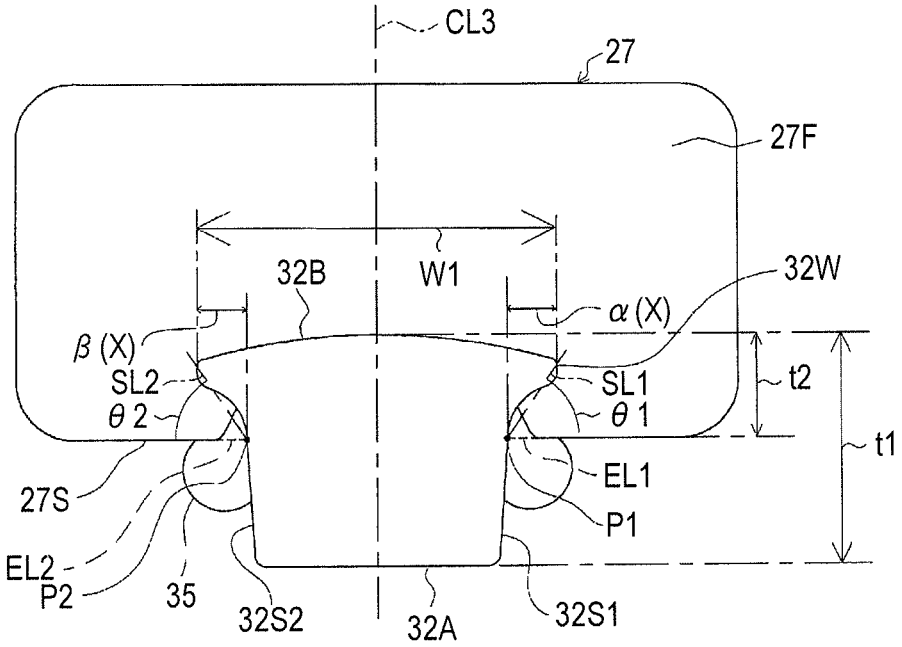
Figure 3B:
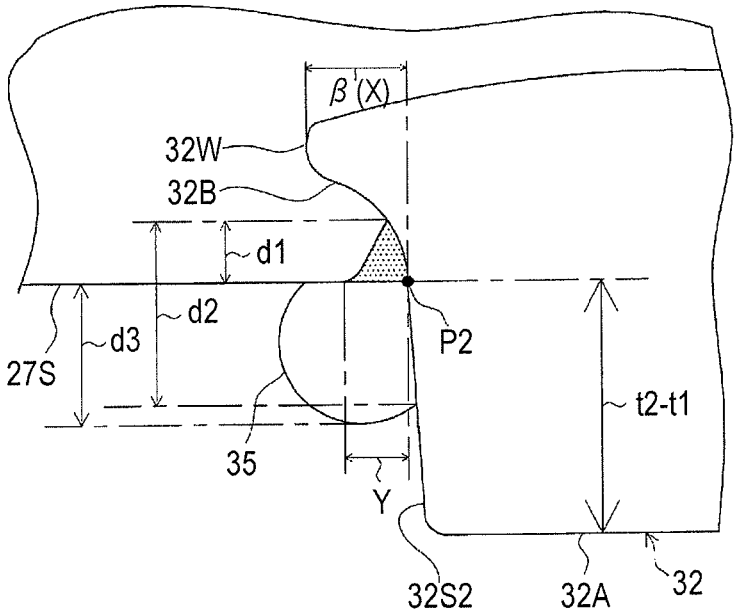

In addition, in the embodiment, one portion of the other end portion of the noble metal tip 32 is buried in the ground electrode 27, and as shown in (a) of FIG. 3 (for simplicity of illustration, hatching is omitted in FIGS. 3 and 5), a buried portion 32B buried into the interior side of the ground electrode 27 from the leading end side side surface 27S of the ground electrode 27 is provided in the other end portion of the noble metal tip 32.

Figure 4:
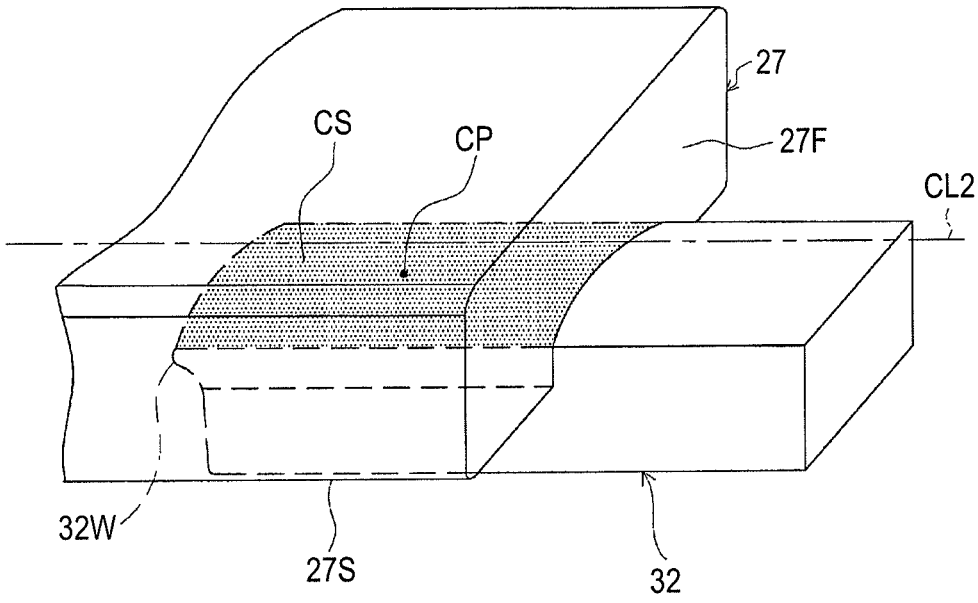
FIG. 4 is a schematic view of the ground electrode and the like for illustrating a junction portion and the center thereof.

Then, in a section, perpendicular to a central axis CL2 of the ground electrode 27, which passes through a center (a gravity center) CP (refer to FIG. 4) of a junction portion CS of the ground electrode 27 and the other end face of the noble metal tip 32, a large width portion 32W larger in width than one end portion 32A of the noble metal tip 32 is formed in the buried portion 32B. Furthermore, a region of the noble metal tip 32 positioned between the leading end side side surface 27S of the ground electrode 27 and the largest width portion of the large width portion 32W is formed so as to gradually increase in width from one end side toward the other end side (large width portion 32W side) of the noble metal tip 32. That is, when straight lines passing through points of intersection P1 and P2 between extended lines EL1 and EL2, wherein the external line of the leading end side side surface 27S is extended to the noble metal tip 32 side, and two side surfaces 32S1 and 3252 each connecting the one end surface and other end surface of the noble metal tip 32 and passing through the end portion in the width direction of the large width portion 32W are taken to be SL1 and SL2, and angles, among angles formed by the straight lines SL1 and SL2 and the external line of the leading end side side surface 27S, formed on the side opposite to that of the noble metal tip 32 are taken to be θ1 and θ2, a configuration is adopted such that each of θ1 and θ2 is less than 90°. In the embodiment, a configuration is adopted such that the width increase rate of the noble metal tip 32 increases gradually from the one end side toward the other end side of the noble metal tip 32. Also, the "section, perpendicular to the central axis CL2 of the ground electrode 27, which passes through the center CP of the junction portion CS of the ground electrode 27 and the other end face of the noble metal tip 32" can also refer to a section, perpendicular to the central axis CL2, which passes through a central axis CL2 direction central position of the noble metal tip 32 between the leading end face 27F of the ground electrode 27 and a surface of the noble metal tip 32 farthest away from the leading end face 27F along the central axis CL2.

Figure 5:
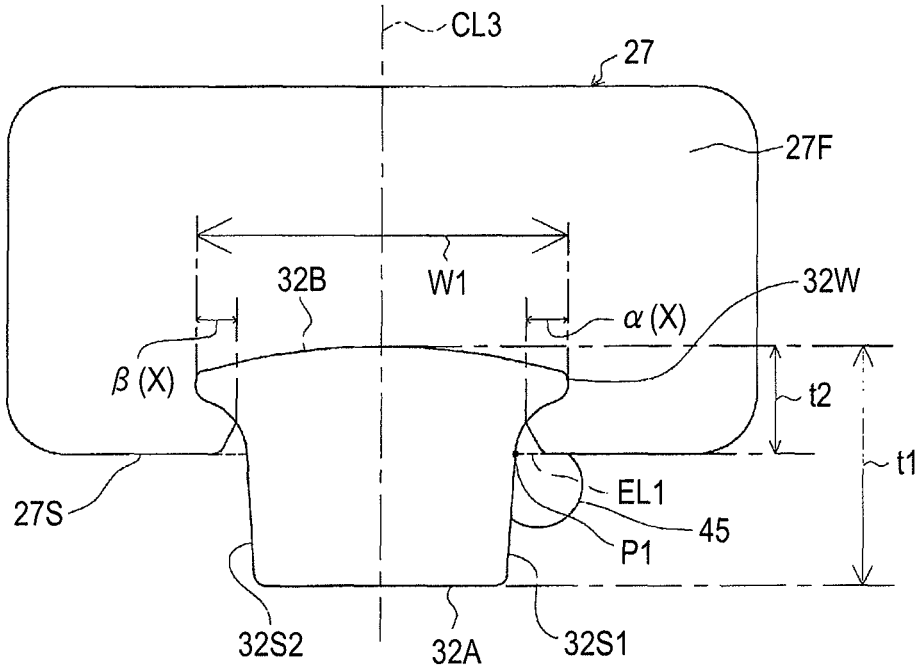
FIG. 5 is an enlarged sectional schematic view showing another example of a melt portion.

Also, the noble metal tip 32 is joined to the ground electrode 27 by a melt portion 35 wherein a metal configuring the noble metal tip 32 and a metal (a ground electrode base material) configuring the ground electrode 27 melt together, and the melt portion 35 is formed protruding to the one end portion side of the noble metal tip 32 by the noble metal tip 32 being buried into the ground electrode 27. Then, the melt portion 35, as well as being in contact with one side surface 32S1, of the two side surfaces 32S1 and 32S2 of the noble metal tip 32, and the ground electrode 27 positioned on the one side surface 32S1 side, is in contact with the other side surface 32S2 and the ground electrode 27 positioned on the other side surface 32S2 side. As shown in FIG. 5, in the heretofore described section, the melt portion 45 may be configured so as to be formed on only the one side surface 32S1 of the noble metal tip 32, and configured so as to make contact with the one side surface 32S1 and the ground electrode 27 positioned on the side surface 32S1 side (also, the melt portion may be formed on only the other side surface 32S2 side).

Returning to (a) of FIG. 3, at least a region of either side surface 32S1 and 32S2 of the noble metal tip 32 positioned between the large width portion 32W and each intersection point P1 and P2 is covered with the base material of the ground electrode 27 and the melt portion 35.

In addition, when a thickness of the noble metal tip 32 along a central axis CL3 of the noble metal tip 32 is taken to be t1 (mm), and an amount of the noble metal tip 32 buried from the leading end side side surface 27S along the central axis CL3 of the noble metal tip 32 is taken to be t2 (mm), the amount of the noble metal tip 32 buried from the ground electrode 27 is set so as to satisfy $0.25 \leq t2/t1 \leq 0.70$. The "thickness t1" refers to a thickness, along the central axis CL3, of the thickest region of the noble metal tip 32, and the "buried amount t2" refers to a depth, from the leading end side side surface 27S along the central axis CL3, of a region of the buried portion 32B buried deepest from the leading end side side surface 27S, in the heretofore described section.

Furthermore, in the embodiment, a configuration is adopted such that a width of the large width portion 32W in a direction perpendicular to the central axis CL3 is sufficiently larger than a width (a distance between the intersection points P1 and P2 in a direction perpendicular to the central axis CL3) of the noble metal tip 32 at the leading end side side surface 27S. Specifically, when a protrusion length of the large width portion 32W, in a direction perpendicular to the central axis CL3 of the noble metal tip 32, positioned on the one side surface 32S1 side, with the intersection point P1 as a reference, is taken to be a (mm), a protrusion length of the large width portion 32W, in a direction perpendicular to the central axis CL3, positioned on the other side surface 32S2 side of the noble metal tip 32, with the intersection point P2 as a reference, is taken to be β (mm), the larger of the two protrusion lengths α and β is taken to be x (mm) (in the embodiment, $\alpha=\beta=x$), and a width, in a direction perpendicular to the central axis CL3, of the largest width portion of the large width portion 32W is taken to be W1 (mm), a configuration is adopted such that $x \geq W1 \times 0.02$ is satisfied.

In addition, as shown in (b) of FIG. 3, the melt portion 35 is formed so that one portion thereof thrusts into the interior side of the ground electrode 27 from the leading end side side surface 27S [the stippled region in (b) of FIG. 3]. In the embodiment, when a distance of the noble metal tip 32 along the central axis CL3 from the leading end side side surface 27S to a region of the melt portion 35 thrusting deepest into the interior side of the ground electrode 27 is taken to be d1 (mm), a configuration is adopted such that d1 0.06 is satisfied.

Also, when a largest width, in a direction perpendicular to the central axis CL3 of the noble metal tip 32, of the region of the melt portion 35 thrusting into the interior side of the ground electrode 27 from the leading end side side surface 27S is taken to be Y (mm), $0.17 \leq Y \leq 0.27$.

Also, when a distance, along the central axis CL3 of the noble metal tip 32, of a region of the melt portion 35 in contact with the one side surface 32S1, or a distance, along the central axis CL3, of a region of the melt portion 35 in contact with the other side surface 32S2, whichever is larger, is taken to be d2 (mm), a configuration is adopted such that $d2 \geq 0.20$ is satisfied.

Furthermore, when a largest protrusion length of the melt portion 35 from the leading end side side surface 27S along the central axis CL3 of the noble metal tip 32 is taken to be d3 (mm), a configuration is adopted such that $d3 \leq t1 - t2$ is satisfied.

In addition, the other end face of the noble metal tip 32 is formed into a curved shape convex toward the interior side of the ground electrode 27.

Figure 6:
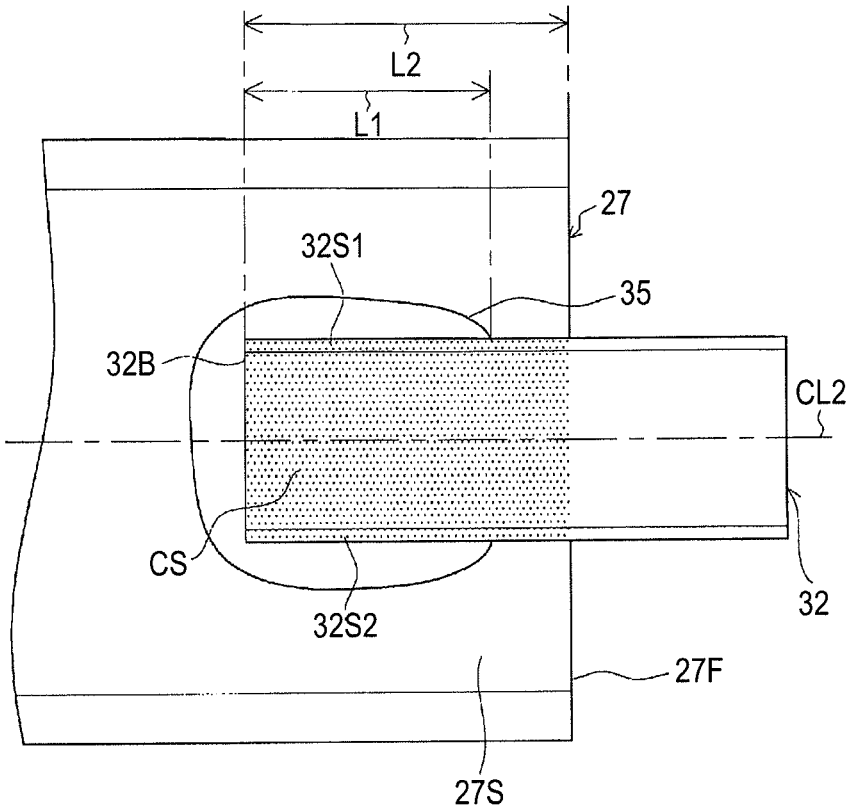

Also, as shown in FIG. 6, within a range corresponding to the junction portion CS of the ground electrode 27 and the other end face of the noble metal tip 32, in a longitudinal direction of the ground electrode 27, when seen from the one end face side of the noble metal tip 32, a length L1 of the melt portion 35 in the longitudinal direction of the ground electrode 27 is set to be equal to or larger than half a length L2 of the junction portion CS in the longitudinal direction of the ground electrode 27.

Next, a description will be given of a method of manufacturing the spark plug 1 configured in the way heretofore described.

Firstly, the metal shell 3 is processed in advance. That is, a cylindrical metal material (for example, an iron-based material or a stainless steel material) is processed by a cold forging or the like, thereby forming an outline, and forming a through hole therein. Subsequently, the external shape is arranged by performing a cutting process, obtaining a metal shell intermediate body.

Continuing, the straight bar-like ground electrode 27 formed from an Ni alloy or the like is resistance welded to the leading end face of the metal shell intermediate body. As a so-called "sagging" occurs when resistance welding, the thread portion 15 is formed in a predetermined region of the metal shell intermediate body by a thread rolling after the "sagging" is removed. By so doing, the metal shell 3 to which the ground electrode 27 is welded is obtained. Also, the metal shell 3 to which the ground electrode 27 is welded is plated with zinc or nickel. In order to improve corrosion resistance, a chromate treatment may be further performed on the surface thereof.

Meanwhile, apart from the metal shell 3, the insulator 2 is processed by a molding in advance. That is, a hollow cylindrical compact is obtained by preparing a molding green body agglomerated material using raw powder containing, for example, a binder with alumina as an agent, and carrying out a rubber press molding using the molding green body agglomerated material. Then, the obtained compact is processed by a cutting and shaped, and the shaped compact is sintered in a sintering furnace, thereby obtaining the insulator 2.

Also, apart from the metal shell 3 and insulator 2, the center electrode 5 is manufactured in advance. That is, an Ni alloy wherein a copper alloy or the like for improving heat radiation is disposed in the central portion is processed by a forging, fabricating the center electrode 5. Next, the noble metal portion 31 formed from a noble metal alloy is joined to the leading end portion of the center electrode 5 by a laser welding or the like.

Next, the insulator 2 and center electrode 5 obtained in the way heretofore described, the resistor 7, and the terminal electrode 6 are sealed and fixed by the glass seal layers 8 and 9. The glass seal layers 8 and 9 are commonly prepared with borosilicate glass and metal powder mixed therein, and the prepared mixture, after being injected into the axial hole 4 of the insulator 2 in such a way as to sandwich the resistor 7, is heated in the sintering furnace while being pressed by the terminal electrode 6 from behind, and thereby sintered firmly. At this time, it may be taken that a glazing layer is simultaneously sintered on the surface of the rear end side barrel portion 10 of the insulator 2, or it may be taken that a glazing layer is formed in advance.

Subsequently, the insulator 2 including the center electrode 5 and terminal electrode 6 each fabricated in the way heretofore described and the metal shell 3 including the ground electrode 27 are fixed. More specifically, the insulator 2 and metal shell 3 are fixed by, after inserting the insulator 2 into the metal shell 3, caulking the metal shell 3 rear end side opening portion, formed to be comparatively thin-walled, inward in the radial direction, that is, forming the caulked portion 20.

Next, the noble metal tip 32 is joined to the leading end portion of the ground electrode 27. Firstly, the noble metal tip 32 of rectangular cross section (rectangular parallelepiped shape) is manufactured in advance by processing a predetermined noble metal material by a forging or the like. Then, after one portion of the noble metal tip 32 is placed on the leading end side side surface 27S of the ground electrode 27, a predetermined welding electrode bar (not shown) is brought into contact with the one end face of the noble metal tip 32. After that, the welding electrode bar is moved to the ground electrode 27 side, and the noble metal tip 32 is energized with a current of a predetermined current value from the welding electrode bar while being pressed with a predetermined pressure by the welding electrode bar. By so doing, the melt portion 35 wherein a metal configuring the ground electrode 27 and a metal configuring the noble metal tip 32 melt together is formed in a form such that the one portion of the noble metal tip 32 is buried into the ground electrode 27 and protruded outside the ground electrode 27 along with the noble metal tip 32 being buried, and the noble metal tip 32 is joined to the ground electrode 27. A region of the noble metal tip 32 positioned in its angled portions and the vicinities thereof, as it is comparatively likely to change in shape, gradually increases in width in the course of the noble metal tip 32 being buried, as a result of which the large width portion 32W is formed. Also, a region of the noble metal tip 32 positioned on the central side of a surface thereof joined to the ground electrode 27 is buried deeper than the angled portion sides of the noble metal tip 32 along with the noble metal tip 32 being pressed, as a result of which the other end face of the noble metal tip 32 is formed into a curved shape.

The distances d1, d2, and d3 can be changed by adjusting the amount of the noble metal tip 32 buried into the ground electrode 27 (for example, it is possible to increase the distances d1, d2, and d3 by increasing the buried amount). Also, the protrusion length x and largest width Y can be changed by adjusting the pressure and current used when pressing. In addition, in the case of forming the melt portion on only one side surface 32S1 side, it is sufficient, when resistance welding, to cause a current flowing on the one side surface 32S1 side to be higher than a current flowing on the other side surface 32S2 side.

After the junction of the noble metal tip 32, the ground electrode 27 is bent to the center electrode 5 side. Then, the heretofore described spark plug 1 is obtained by adjusting the size of the spark discharge gap 33 between the noble metal portion 31 and noble metal tip 32.

As heretofore described in detail, according to the embodiment, the region of the noble metal tip 32 positioned between the leading end side side surface 27S of the ground electrode 27 and the largest width region of the large width portion 32W is formed into a shape such as to gradually increase in width from the one end side toward the other end side of the noble metal tip 32. Consequently, it is possible to prevent a space being formed between the side surfaces of the noble metal tip 32 and the ground electrode 27 when burying the noble metal tip 32 into the ground electrode 27, and it is possible to secure a sufficient area of contact between the two. Also, it is possible to suppress an infiltration of oxygen into the junction portion of the noble metal tip 32 and ground electrode 27 by suppressing the formation of the space.

Furthermore, according to the embodiment, the buried amount of the noble metal tip 32 is made large enough to satisfy $0.25 \leq t2/t1$, and a region of the ground electrode 27 retained by the large width portion 32W is sufficiently thick-walled. As a result of this, it is possible to reliably increase the force of retention of the noble metal tip 32 in the ground electrode 27.

In addition, in the heretofore described section, the region of either side surface 3251, 32S2 of the noble metal tip 32 from the large width portion 32W to the intersection point P1, P2 is covered with the base material of the ground electrode 27 and the melt portion 35. Consequently, as well as it being possible to suppress the formation of the space between the noble metal tip 32 and ground electrode 27, it is possible to effectively suppress an infiltration of oxygen between the two.

As above, according to the embodiment, it is possible to dramatically improve the strength of junction of the noble metal tip 32 to the ground electrode 27 by increasing the force of retention of the large width portion 32W in the ground electrode 27 while securing a sufficient area of contact between the noble metal tip 32 and ground electrode 27. Also, it is possible to suppress an oxidized scale growth by covering the region between either side surface 32S1 and 32S2 of the noble metal tip 32 and the ground electrode 27 with the base material of the ground electrode 27 and the melt portion 35, while suppressing the formation of the space between the noble metal tip 32 and ground electrode 27, and it is thus possible to maintain a superior junction strength over a long period. As a result of this, it is possible to effectively prevent the noble metal tip 32 dropping off.

Furthermore, in the embodiment, as well as the protrusion length x and distances d1 and d2 being set in the way heretofore described, the melt portion 35 is formed over a wide range between both side surfaces 32S1 and 32S2 of the noble metal tip 32 and the ground electrode 27, and furthermore, the other end face of the noble metal tip 32 is formed into a curved shape. Because of this, it is possible to very effectively improve the strength of junction of the noble metal tip 32 to the ground electrode 27.

In addition, as the largest width Y is set to 0.27 mm or less, and the largest protrusion length d3 to t1−t2 or less, it is possible to stabilize a spark hitting position. At the same time, as a configuration is adopted such that the noble metal tip 32 protrudes from the leading end face 27F of the ground electrode 27, and t2/t1≤0.70 is satisfied, it is possible to effectively suppress a flame kernel growth inhibition due to the ground electrode 27. That is, according to the embodiment, it being possible to realize both the spark hitting position stabilization and a flame kernel growth promotion, it is possible to sufficiently improve ignitability.

Figure 7:
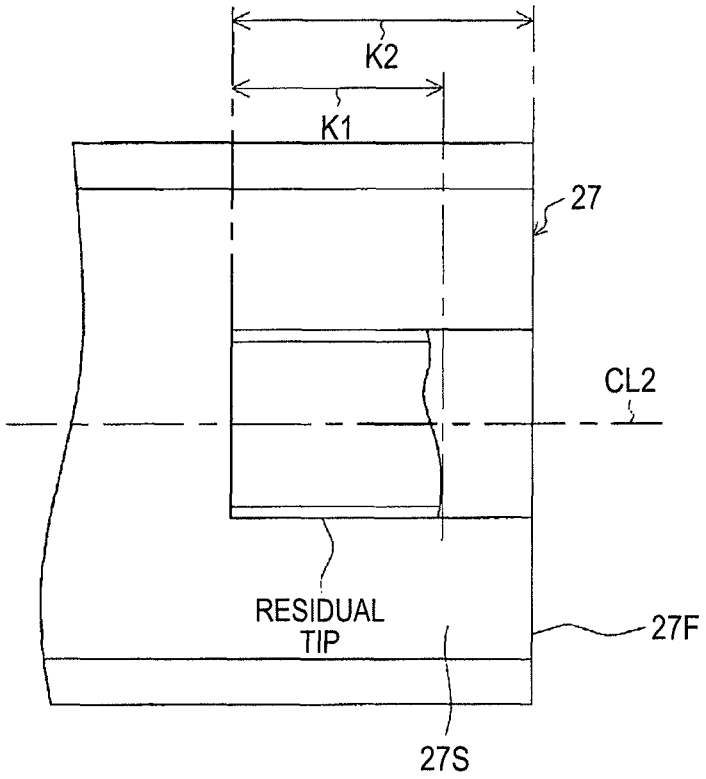
FIG. 7 is a schematic view for illustrating lengths K1 and K2 in an ultrasonic horn test.

Next, in order to confirm the working effects achieved by the heretofore described embodiment, spark plug samples are fabricated wherein, after each of the angles θ1 and θ2 is set to 100°, 90°, 80°, or 70°, each of the thickness t1 (mm) of the noble metal tip along the central axis of the noble metal tip and the amount t2 (mm) of the noble metal tip buried from the leading end side surface (junction target surface) of the ground electrode along the central axis of the noble metal tip is changed, thereby changing t2/t1 variously, and an ultrasonic horn test is carried out on each sample. The outline of the ultrasonic horn test is as follows. That is, the ground electrode of each sample is vibrated at a frequency of 27.3 kHz using an ultrasonic horn until the noble metal tip is broken and one portion of the broken noble metal tip drops off from the ground electrode. Then, as shown in FIG. 7, a length K1, in the longitudinal direction of the ground electrode, of a noble metal tip remaining without dropping off from the ground electrode (a residual tip) is measured, and a ratio of the length K1 to a length K2, in the longitudinal direction of the ground electrode, of the junction portion of the noble metal tip and ground electrode before the test (K1/K2; a residual tip ratio) is calculated. Herein, it is taken that samples with the residual tip ratio set to 50% or more are given a "○" evaluation as they are superior in the strength of junction of the noble metal tip to the ground electrode, and that samples with the residual tip ratio set to less than 50% are given a "x" evaluation as they are inferior in the strength of junction. Results of the test are shown in Table 1. A noble metal tip is provided in each sample in such a way as to protrude from the leading end face of the ground electrode, and the length of the noble metal tip protruding from the leading end face of the ground electrode is set to 0.65 mm. Also, in samples with θ1 set to 70° or 80°, a region of the noble metal tip between the leading end side side surface and the largest width region of the large width portion is formed into a shape such as to gradually increase in width from the one end side toward the other end side of the noble metal tip.

TABLE 1

| θ1, θ2 | t1 (mm) | t2 (mm) | t2/t1 | Residual tip ratio | Evaluation |
|---|---|---|---|---|---|
| 100° | 0.7 | 0.150 | 0.214 | 20% | X |
| | | 0.175 | 0.250 | 22% | X |
| | | 0.200 | 0.286 | 29% | X |
| 90° | | 0.150 | 0.214 | 15% | X |
| | | 0.175 | 0.250 | 26% | X |
| | | 0.200 | 0.286 | 22% | X |
| 80° | | 0.150 | 0.214 | 30% | X |
| | | 0.175 | 0.250 | 58% | ○ |
| | | 0.200 | 0.286 | 62% | ○ |
| 70° | | 0.150 | 0.214 | 27% | X |
| | | 0.175 | 0.250 | 56% | ○ |
| | | 0.200 | 0.286 | 69% | ○ |
| 100° | 0.3 | 0.050 | 0.167 | 18% | X |
| | | 0.075 | 0.250 | 23% | X |
| | | 0.100 | 0.333 | 24% | X |
| 90° | | 0.050 | 0.167 | 20% | X |
| | | 0.075 | 0.250 | 31% | X |
| | | 0.100 | 0.333 | 48% | X |

TABLE 1-continued

| θ1, θ2 | t1 (mm) | t2 (mm) | t2/t1 | Residual tip ratio | Evaluation |
|---|---|---|---|---|---|
| 80° | | 0.050 | 0.167 | 23% | X |
| | | 0.075 | 0.250 | 69% | ○ |
| | | 0.100 | 0.333 | 77% | ○ |
| 70° | | 0.050 | 0.167 | 34% | X |
| | | 0.075 | 0.250 | 70% | ○ |
| | | 0.100 | 0.333 | 79% | ○ |

As shown in Table 1, it is found that the samples with the angles θ1 and θ2 set to 100° or 90° (that is, the samples wherein no large width portion is formed in the noble metal tip), being such that the larger proportion of the noble metal tip drops off, are inferior in the strength of junction. Also, it is confirmed that samples, of the samples with the angles θ1 and θ2 set to less than 90°, wherein t2/t1 is set to less than 0.25, are also inferior in the strength of junction.

As opposed to this, it is found that the samples with the angles θ1 and θ2 set to 80° or 70° (that is, the samples wherein the large width portion is formed in the noble metal tip) wherein t2/t1 is set to 0.25 or more, being such that the residual tip ratio is 50% or more, have a superior strength of junction. It is conceivable that this is because the force of retention of the noble metal tip in the ground electrode has increased by the buried amount of the noble metal tip being made sufficiently large, and the region of the ground electrode in which the large width portion is retained being sufficiently thick-walled.

Figure 8:
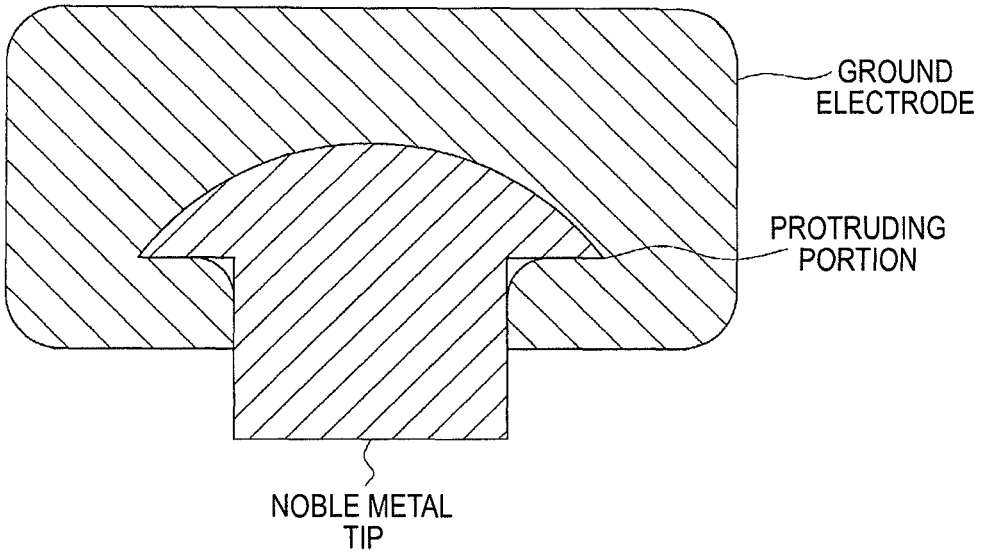
FIG. 8 is a partial enlarged sectional view of a sample corresponding to a comparison example.
Figure 9:
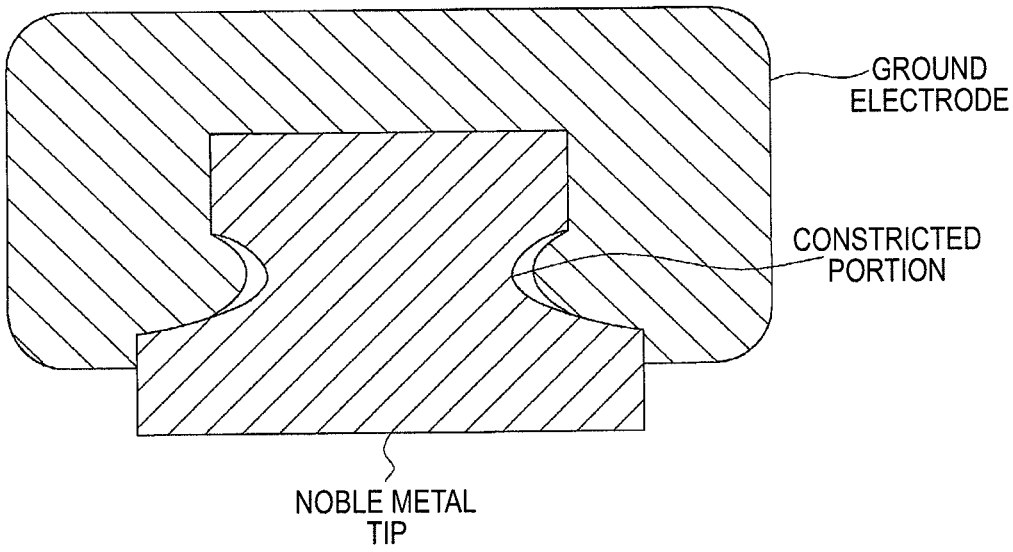
FIG. 9 is a partial enlarged sectional view of a sample corresponding to a comparison example.
Figure 10:
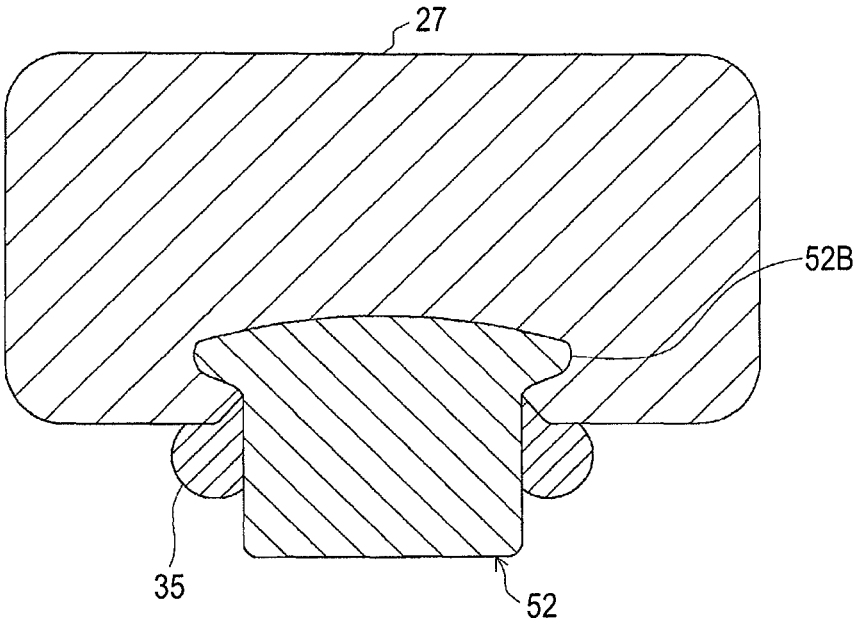
FIG. 10 is a partial enlarged sectional view showing a configuration of a noble metal tip in another embodiment.

Although not shown in Table 1, when the heretofore described test is also carried out on a sample wherein a flanged projecting portion bulging to a radially outer side is provided in either region of the noble metal tip buried in the ground electrode, and the outside diameter of the buried portion of the noble metal tip is exponentially increased (refer to FIG. 8), and on a sample wherein a constricted portion is provided in the buried portion of the noble metal tip (refer to FIG. 9), it is found that the samples, being such that the residual tip ratio is less than 50%, are inferior in the strength of junction. It is conceivable that this is because a space is formed between the ground electrode and noble metal tip due to the effects of the projecting portion and constricted portion when the noble metal tip is buried into the ground electrode.

It can be said from the above test results that, in order to improve the strength of junction of the noble metal tip to the ground electrode, it is preferable to adopt a configuration such that, as well as the noble metal tip being buried into the ground electrode, the large width portion is provided in the buried portion of the noble metal tip, and 0.25≤t2/t1 is satisfied.

Next, spark plug samples wherein t2/t1 is variously changed after each of the angles θ1 and θ2 has been set to 100°, 90°, or 80° are fabricated, and an ignitability evaluation test is carried out on each sample. The outline of the ignitability evaluation test is as follows. That is, after each sample has been mounted in a predetermined engine, the air/fuel ratio of samples with t1 set to 0.7 mm is set to 23.0, the air/fuel ratio of samples with t1 set to 0.3 mm is set to 22.0 (that is, the air/fuel ratio is very much approximated to the air/fuel ratio of an ignition limit), a voltage is applied 1000 times to each sample, and the number of occurrences of misfiring (a misfiring quantity) is measured. Herein, samples with a misfiring quantity of less than ten are given a "○" evaluation as they are superior in ignitability, while samples with a misfiring quantity of ten or more is given a "Δ" evaluation as they are slightly inferior in ignitability. Results of the test are shown in Table 2.

Each sample is taken to be such that the noble metal tip is provided therein in such a way as to protrude from the leading end face of the ground electrode, and the length of the noble metal tip protruding from the leading end face of the ground electrode is 0.65 mm. Also, it is taken that each sample has the same size of spark discharge gap.

TABLE 2

| θ1, θ2 | t1 (mm) | t2 (mm) | t2/t1 | Misfiring quantity | Evaluation |
|---|---|---|---|---|---|
| 100° | 0.7 | 0.350 | 0.500 | 0 | ○ |
| | | 0.420 | 0.600 | 0 | ○ |
| | | 0.490 | 0.700 | 3 | ○ |
| | | 0.520 | 0.743 | 13 | Δ |
| 90° | | 0.350 | 0.500 | 0 | ○ |
| | | 0.420 | 0.600 | 0 | ○ |
| | | 0.490 | 0.700 | 1 | ○ |
| | | 0.520 | 0.743 | 14 | Δ |
| 80° | | 0.350 | 0.500 | 0 | ○ |
| | | 0.420 | 0.600 | 1 | ○ |
| | | 0.490 | 0.700 | 2 | ○ |
| | | 0.520 | 0.743 | 12 | Δ |
| 100° | 0.3 | 0.150 | 0.500 | 2 | ○ |
| | | 0.180 | 0.600 | 1 | ○ |
| | | 0.240 | 0.700 | 0 | ○ |
| | | 0.230 | 0.767 | 13 | Δ |
| 90° | | 0.150 | 0.500 | 1 | ○ |
| | | 0.180 | 0.600 | 2 | ○ |
| | | 0.240 | 0.700 | 2 | ○ |
| | | 0.230 | 0.767 | 11 | Δ |
| 80° | | 0.150 | 0.500 | 0 | ○ |
| | | 0.180 | 0.600 | 1 | ○ |
| | | 0.240 | 0.700 | 1 | ○ |
| | | 0.230 | 0.767 | 13 | Δ |

As shown in Table 2, it is confirmed that the samples with t2/t1 set to more than 0.70 are slightly inferior in ignitability. It is conceivable that this is because the ground electrode is put into proximity to the spark discharge gap due to the fact that the amount of the one end portion of the noble metal tip protruding from the ground electrode has decreased due to increasing the buried amount t2 to excess, as a result of which a flame kernel growth has become liable to be inhibited by the ground electrode.

As opposed to this, it is found that the samples with t2/t1 set to 0.70 or less have superior ignitability.

It can be said from the above test results that, in order to improve ignitability, it is preferable to adopt a configuration such that t2/t1≤0.70 is satisfied.

Next, spark plug samples wherein the protrusion length x (mm) is variously changed after a width W1 of the large width portion has been set to 1.0 mm or 0.7 mm are fabricated, and a high frequency thermal test is carried out on each sample. The outline of the high frequency thermal test is as follows. That is, each sample, after being heated by a high frequency heater for two minutes in such a way that the temperature of the noble metal tip reaches 1000° C. in an ambient air atmosphere, is slowly cooled for one minute, and with this treatment as one cycle, 1000 cycles are implemented. By observing the sections of the samples after 1000 cycles are finished, the ratio (oxidized scale ratio) of the length of an oxidized scale formed in the junction portion of the other end face of the noble metal tip and the ground electrode to the length of the junction portion is measured. Herein, samples with an oxidized scale ratio of 30% or less are given a "◎" evaluation as they are far superior in the detachment resistance (strength of junction) of the noble metal tip, and samples with an oxidized scale ratio of 50% or less are given a "○" evaluation as they are superior in the detachment resistance. Meanwhile, samples wherein the oxidized scale ratio exceeds 50% are given a "Δ" evaluation as they are slightly inferior in the detachment resistance. Results of the test are shown in Table 3. Each sample is taken to be such that the noble metal tip is provided therein in such a way as to protrude from the leading end face of the ground electrode, and the length of the noble metal tip protruding from the leading end face of the ground electrode is 0.65 mm. Also, each sample is taken to be such that the thickness t1 of the noble metal tip is 0.7 mm, the buried amount t2 is 0.3 mm, and each of the angles θ1 and θ2 is 80°.

TABLE 3

| x (mm) | W1 (mm) | W1 × 0.02 (mm) | Oxidized scale ratio | Evaluation |
|---|---|---|---|---|
| 0.01 | 1 | 0.02 | 38% | ○ |
| 0.02 | | | 22% | ◎ |
| 0.05 | | | 10% | ◎ |
| 0.010 | 0.7 | 0.014 | 46% | ○ |
| 0.015 | | | 22% | ◎ |
| 0.020 | | | 13% | ◎ |

As shown in Table 3, it is found that each sample has superior detachment resistance, but that the samples wherein the protrusion length x is set to 0.02 times or more the width W1 of the large width portion, being such that the oxidized scale ratio is 30% or less, have far superior detachment resistance. It is conceivable that this is because it is possible, by increasing the protrusion length x, to secure a sufficiently large distance from a place into which oxygen infiltrates (a boundary portion between a side surface of the noble metal tip and the melt portion and ground electrode) to the junction portion.

It can be said from the above test results that, in order to suppress an oxidized scale growth and improve the detachment resistance of the noble metal tip, it is preferable to adopt a configuration such that the protrusion length x and the width W1 of the large width portion satisfy x≥W1×0.02.

Next, samples 1 to 3 wherein the length of the melt portion in the longitudinal direction of the ground electrode is variously changed are fabricated, and the heretofore described high frequency thermal test is carried out on each sample. Results of the test are shown in Table 4. The sample 1 is such that in a section, perpendicular to the central axis of the ground electrode, which passes through the center of the junction portion of the ground electrode and the other end face of the noble metal tip, no melt portion is formed between either side surface of the noble metal tip and the ground electrode (that is, the length of the melt portion in the longitudinal direction of the ground electrode is set to be less than half the heretofore described length L2 of the junction portion in the longitudinal direction of the ground electrode). Also, the sample 2 is such that, in the heretofore described section, the melt portion exists on only one side surface side of the noble metal tip (that is, the length of the melt portion formed on one side surface side of the noble metal tip is set to be equal to or larger than half the length L2, while the length of the melt portion formed on the other side surface side of the noble metal tip is set to be smaller than half the length L2). Furthermore, the sample 3 is such that, in the heretofore described section, the melt portion exists on either side surface side of the noble metal tip (that is, each of the lengths of the melt portions formed on the two side surface sides of the noble metal tip is set to be equal to or larger than half the length L2). Each of the samples 1 to 3 is taken to be such that the length of the noble metal tip protruding from the leading end face of the ground electrode is 0.65 mm, the thickness t1 of the noble metal tip is 0.7 mm, the buried amount t2 of the noble metal tip is 0.3 mm, and each of the angles θ1 and θ2 is 80°.

TABLE 4

| | Oxidized scale ratio | Evaluation |
|---|---|---|
| Sample 1 | 66% | Δ |
| Sample 2 | 38% | ○ |
| Sample 3 | 25% | ◎ |

As shown in Table 4, it is found that the samples 2 and 3 configured in such a way that the melt portion exists on at least one side surface side of the noble metal tip in the heretofore described section are superior in the detachment resistance of the noble metal tip. It is conceivable that this can be attributed to the fact that it is possible to more reliably suppress an infiltration of oxygen into the junction portion by the melt portion with a sufficient length being provided so as to cover the region between the side surface of the noble metal tip and the ground electrode. Also, in particular, it is found that the sample 3 configured in such away that the melt portion exists on either side surface side of the noble metal tip has far superior detachment resistance.

It can be said from the above test results that, in order to improve the detachment resistance, it is preferable to adopt a configuration such that, in the heretofore described section, the melt portion is brought into contact with at least one of the two side surfaces of the noble metal tip and the ground electrode positioned on the one side surface side (in other words, when seen from the one end portion side of the noble metal tip, within a range corresponding to the junction portion of the ground electrode and the other end face of the noble metal tip, a length, in the longitudinal direction of the ground electrode, of a region of the melt portion formed on at least one side surface side of the noble metal tip is set to be equal to or larger than half a length of the junction portion in the longitudinal direction of the ground electrode). Also, it can be said that, from the viewpoint of further improving the detachment resistance, it is more preferable to adopt a configuration such that, in the heretofore described section, the melt portion, as well as being brought into contact with one side surface of the noble metal tip and the ground electrode positioned on the one side surface side, is brought into contact with the other side surface of the noble metal tip and the ground electrode positioned on the other side surface side (in other words, when seen from the one end portion side of the noble metal tip, within the range corresponding to the junction portion of the ground electrode and the other end face of the noble metal tip, each of lengths, in the longitudinal direction of the ground electrode, of two regions of the melt portion formed on either side surface side of the noble metal tip is set to be equal to or larger than half the length of the junction portion in the longitudinal direction of the ground electrode).

Next, spark plug samples are fabricated wherein the distance d1 (mm) along the central axis of the noble metal tip from the leading end side side surface of the ground electrode to a region of the melt portion thrusting deepest into the interior side of the ground electrode is variously changed, and the heretofore described high frequency thermal test is carried out on each sample. Results of the test are shown in Table 5. Each sample is taken to be such that the thickness t1 of the noble metal tip is 0.7 mm, the buried amount t2 of the noble metal tip is 0.3 mm, each of the angles θ1 and θ2 is 75°, the width W1 of the large width portion is 0.7 mm, and the protrusion length x is 0.01 mm (in the following tests, in each sample, the values of t1, t2, and the like are taken to be the same as these).

TABLE 5

| d1 (mm) | Oxidized scale ratio | Evaluation |
|---|---|---|
| 0.04 | 46% | ○ |
| 0.06 | 27% | ◎ |
| 0.1 | 20% | ◎ |

As shown in Table 5, it is found that the samples with the distance d1 set to 0.06 mm or more have far superior detachment resistance. It is conceivable that this is because an infiltration of oxygen into the junction portion of the noble metal tip and ground electrode is effectively suppressed by the portion of contact between the noble metal tip and ground electrode being covered with the thick-walled melt portion.

It can be said from the above test results that, in order to improve the detachment resistance, it is preferable to adopt a configuration such that d1≥0.06 is satisfied.

Next, spark plug samples are fabricated wherein the largest width Y (mm), in a direction perpendicular to the central axis of the noble metal tip, of a region of the melt portion thrusting into the interior side of the ground electrode from the leading end side side surface of the ground electrode is variously changed, and the heretofore described high frequency thermal test and a spark hitting position confirmation test are carried out on each sample.

The outline of the spark hitting position confirmation test is as follows. That is, after each sample has been mounted in a predetermined chamber, 100 spark discharges are performed for each sample, and the number of spark discharges generated between the center electrode and noble metal tip (a tip hitting spark quantity) is measured. Herein, samples with a tip hitting spark quantity of 50 or more are given a "○" evaluation as they can stably generate spark discharges at a regular position, and are superior in ignitability, while a sample with a tip hitting spark quantity of less than 50 is given a "Δ" evaluation as it has unstable spark hitting positions, and is slightly inferior in ignitability. Results of the high frequency thermal test are shown in Table 6, and results of the spark hitting position confirmation test are shown in Table 7.

TABLE 6

| Y (mm) | Oxidized scale ratio | Evaluation |
|---|---|---|
| 0.12 | 46% | ○ |
| 0.17 | 24% | ◎ |
| 0.22 | 23% | ◎ |

TABLE 7

| Y (mm) | Tip hitting spark quantity | Evaluation |
|---|---|---|
| 0.22 | 87 | ○ |
| 0.27 | 66 | ○ |
| 0.30 | 35 | Δ |

As shown in Table 6, it is revealed that the samples with the largest width Y set to 0.17 mm or more, being such that the oxidized scale ratio is equal to or lower than 30%, are far superior in the detachment resistance. It is conceivable that this is because the sufficiently voluminous melt portion is formed in such a way as to close the junction portion of the ground electrode and noble metal tip, thereby reliably suppressing an infiltration of oxygen into the junction portion.

Meanwhile, as shown in Table 7, it is confirmed that the samples with the largest width set to more than 0.27 mm, being such that the spark hitting position is not stable, are slightly inferior in ignitability. It is conceivable that this is because the volume of the melt portion has increased to excess, and the melt portion has come closer to the spark discharge gap.

It can be said from the above test results that, in order to improve both the detachment resistance and ignitability, it is preferable to adopt a configuration such that the largest width Y (mm) of the region of the melt portion thrusting into the interior side of the ground electrode satisfies $0.17 \leq Y \leq 0.27$.

Next, spark plug samples wherein the distance d2 (mm) is variously changed are fabricated, and the heretofore described high frequency thermal test is carried out on each sample. Results of the test are shown in Table 8.

TABLE 8

| d2 (mm) | Oxidized scale ratio | Evaluation |
|---|---|---|
| 0.15 | 35% | ○ |
| 0.20 | 22% | ◎ |
| 0.25 | 20% | ◎ |

As shown in Table 8, it is confirmed that the samples with the distance d2 set to 0.20 mm or more are far superior in the detachment resistance. It is conceivable that this is because an infiltration of oxygen into the junction portion has been reliably suppressed by sufficiently increasing the area of contact between the melt portion and the side surfaces of the noble metal tip.

It can be said from the above test results that, in order to improve the detachment resistance, it is preferable to adopt a configuration such that the distance d2 (mm) satisfies $d2 \geq 0.20$.

Next, spark plug samples wherein the largest protrusion length d3 (mm) of the melt portion from the leading end side side surface of the ground electrode is variously changed are fabricated, and the heretofore described spark hitting position confirmation test is carried out on each sample. Results of the test are shown in Table 9. Although heretofore described, each sample is taken to be such that the thickness t1 of the noble metal tip is 0.7 mm, and the buried amount t2 of the noble metal tip is 0.3 mm (that is, t1−t2 is 0.4 mm).

TABLE 9

| d3 (mm) | Tip hitting spark quantity | Evaluation |
|---|---|---|
| 0.2 | 92 | ○ |
| 0.4 | 53 | ○ |
| 0.6 | 27 | Δ |

As shown in Table 9, it is revealed that the sample with the largest protrusion length d3 set to more than 0.4 mm, that is, the sample with the largest protrusion length d3 set to be larger than the protrusion length (t1−t2) of the noble metal tip from the leading end side side surface, being such that the spark hitting position is not stable, is slightly inferior in ignitability. It is conceivable that this can be attributed to the fact that the melt portion has been formed in a condition in which it protrudes to the spark discharge gap side from the one end face of the noble metal tip.

As opposed to this, it is confirmed that the samples with the largest protrusion length d3 set to 0.4 mm or less, that is, the samples with the largest protrusion length set to be equal to or smaller than the protrusion length (t1−t2) of the noble metal tip, being such that the spark hitting position is stable, have superior ignitability.

It can be said from the above test results that, in order to further improve ignitability, it is preferable to adopt a configuration such that the largest protrusion length d3 (mm) satisfies $d3 \geq t1 - t2$.

Next, a spark plug sample A, wherein the other end face of the noble metal tip is formed to be planar, and a spark plug sample B, wherein the other end face of the noble metal tip is formed into a curved shape convex toward the interior side of the ground electrode, are fabricated, and the heretofore described high frequency thermal test is carried out on both samples. Results of the test are shown in Table 10.

TABLE 10

| | Oxidized scale ratio | Evaluation |
|---|---|---|
| Sample A | 44% | ○ |
| Sample B | 17% | ◎ |

As shown in Table 10, it is revealed that the sample B wherein the other end face of the noble metal tip is formed into the curved shape is far superior in the detachment resistance. It is conceivable that this is because the ratio of oxidized scales to the whole of the junction portion can be sufficiently reduced even though some oxidized scales appear in the junction portion.

It can be said from the above test results that, in order to further improve the detachment resistance, it is preferable that the other end face of the noble metal tip is formed into a curved shape convex toward the interior side of the ground electrode.

The invention, not being limited to the contents described in the heretofore described embodiment, may be implemented in, for example, the following ways. It goes without saying that other application examples and modification examples which are not illustrated below are also possible as a matter of course.

(a) In the heretofore described embodiment, the buried portion 32B is formed into a shape such as to gradually increase in width from the one end side toward the other end side of the noble metal tip 32. As opposed to this, a buried portion 52B may be configured in such a way as to have a region having a constant width, and a region gradually increasing in width, from the one end side toward the other end side of the noble metal tip 32. Even in this case, it is possible to reliably prevent a space from being formed between the ground electrode 27 and noble metal tip 52, and it is possible to improve the strength of junction of the noble metal tip 52.

Figure 11:
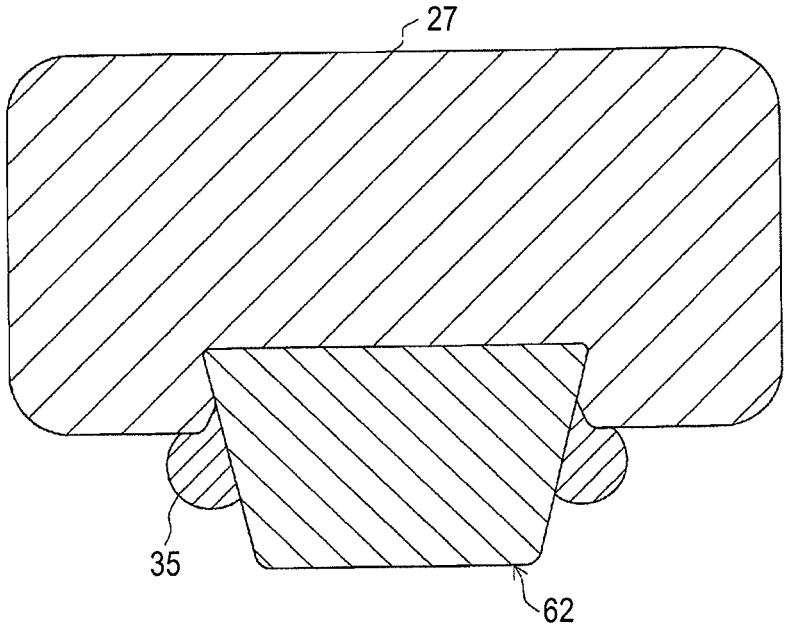
FIG. 11 is a partial enlarged sectional view showing a configuration of a noble metal tip in another embodiment.

(b) In the heretofore described embodiment, a configuration is adopted such that the large width portion 32W is formed when joining the noble metal tip 32 of rectangular cross section to the ground electrode 27 but, for example, as shown in FIG. 11, it may be taken that a noble metal tip 62 is formed into a trapezoidal cross-sectional shape in advance, and joined to the ground electrode 27 in a condition in which it is buried in the ground electrode 27. Also, in the heretofore described embodiment, the other end face of the noble metal tip 32 is formed into a curved shape, but the other end face of the noble metal tip 62 may be formed to be planar.

Figure 12:
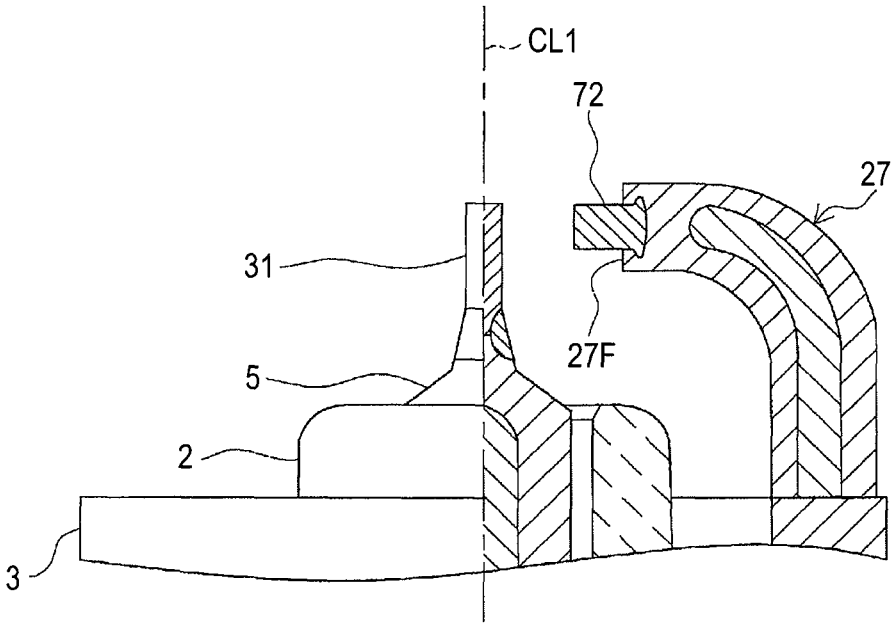
FIG. 12 is a partially sectioned enlarged front view showing a configuration of the leading end portion of a spark plug in another embodiment.

(c) In the heretofore described embodiment, the noble metal tip 32 is joined to the leading end side side surface 27S of the ground electrode 27, but a surface of the ground electrode 27 to which the noble metal tip 32 is joined is not limited to this (that is, the junction target surface is not limited to the leading end side side surface 27S). Consequently, as shown in FIG. 12, it may be taken that a noble metal tip 72 is joined to the leading end face 27F of the ground electrode 27. Also, it may be taken that one end face of the noble metal tip is opposed to the side surface of the center electrode 5 (noble metal portion 31) without the one end face of the noble metal tip being opposed to the leading end face of the center electrode 5 (noble metal portion 31).

Figure 13:
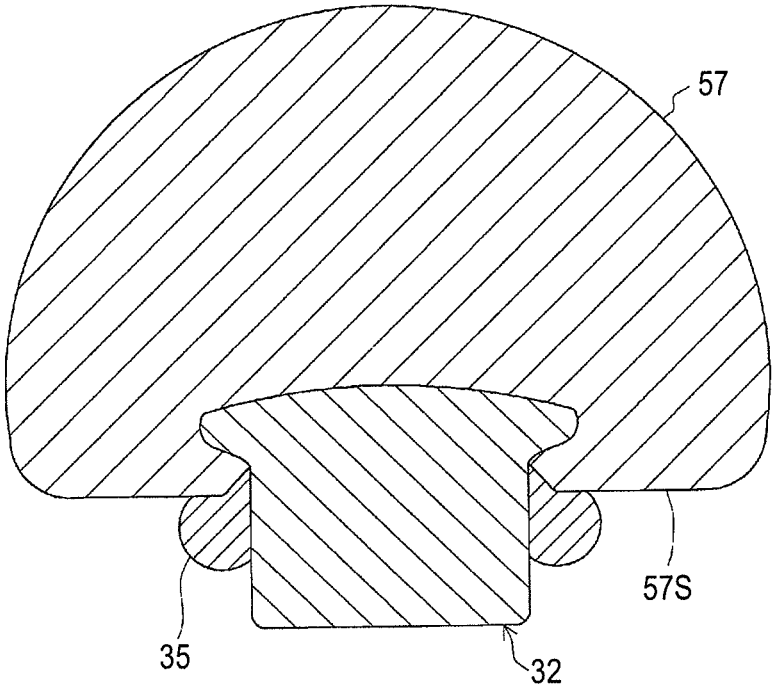
FIG. 13 is a partial enlarged sectional view showing a configuration of a ground electrode in another embodiment.
Figure 14:
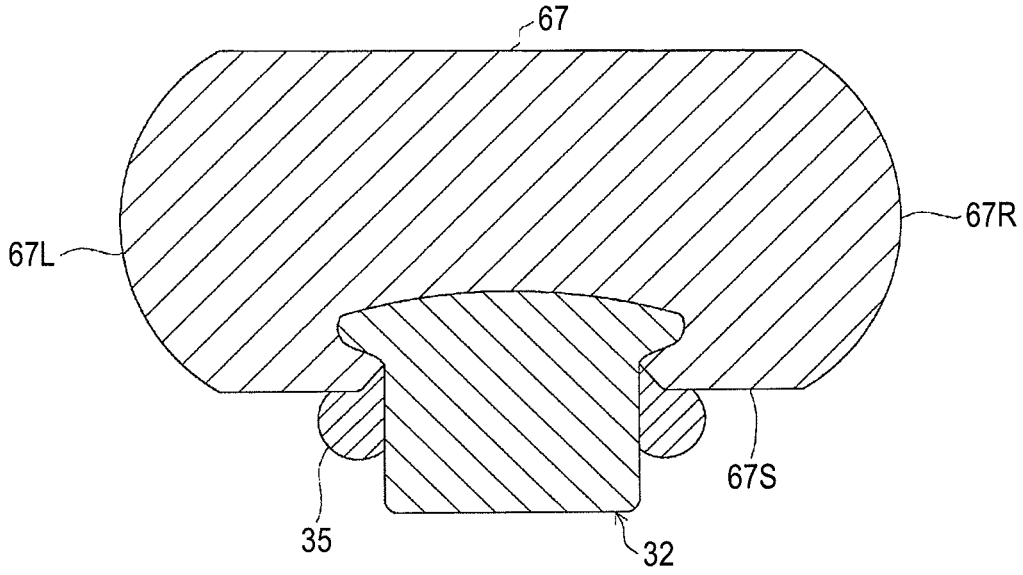
FIG. 14 is a partial enlarged sectional view showing a configuration of a ground electrode in another embodiment.
Figure 15:
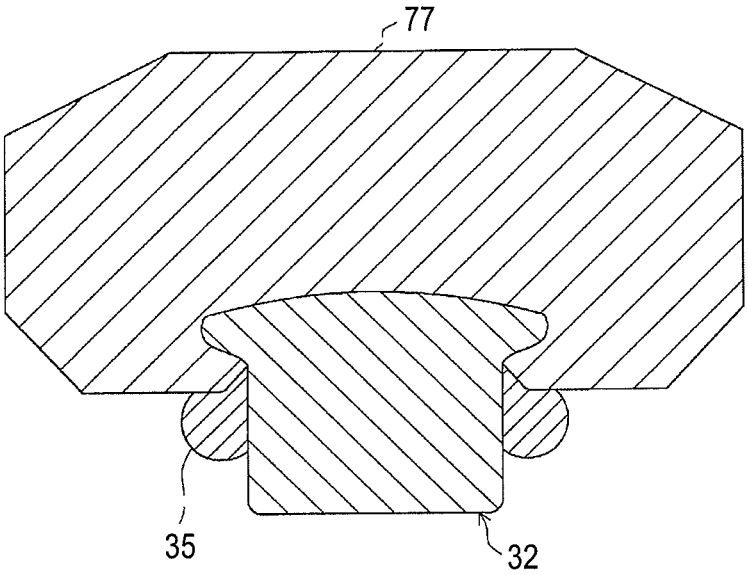
FIG. 15 is a partial enlarged sectional view showing a configuration of a ground electrode in another embodiment.

(d) In the heretofore described embodiment, the ground electrode 27 is formed into a rectangular cross-sectional shape, but the cross-sectional shape of the ground electrode is not limited to this. Consequently, for example, as shown in FIG. 13, it may be taken that a ground electrode 57 is configured in such a way that a leading end side side surface 57S is formed to be planar, while the other surface is formed into a curved shape convex outward. Also, as shown in FIG. 14, it may be taken that a ground electrode 67 is configured in such a way that both side surfaces 67L and 67R adjacent to a leading end side side surface 67S are formed into a curved shape convex outward. Furthermore, as shown in FIG. 15, it may be taken that the regions between adjacent side surfaces of a ground electrode 77 are chamfered. In this case, a fuel gas becomes likely to make its way into the spark discharge gap 33 in a form such as to flow down the ground electrode, and it is possible to further improve ignitability.

Figure 16:
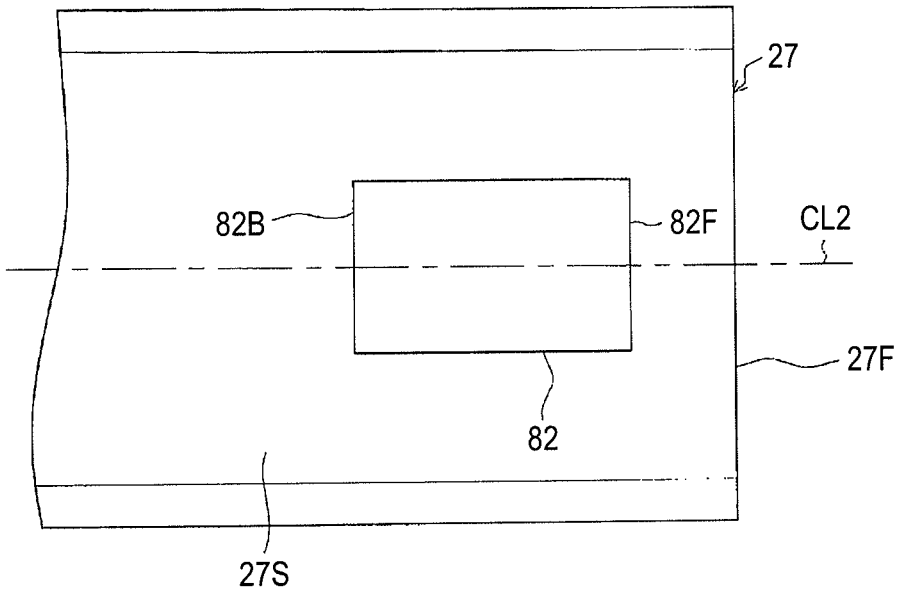
FIG. 16 is an enlarged plan view showing a form of junction of a noble metal tip to a ground electrode in another embodiment.

(e) In the heretofore described embodiment, the noble metal tip 32 is joined to the ground electrode 27 in such a way as to protrude from the leading end face of the ground electrode 27, but as shown in FIG. 16, it may be taken that a noble metal tip 82 is joined to the ground electrode 27 without being protruded from the leading end face of the ground electrode 27. In this case, the "section, perpendicular to the central axis of the ground electrode, which passes through the center of the junction portion of the ground electrode and the other end face of the noble metal tip" can also refer to a section, perpendicular to the central axis CL2, which passes through a central position, in the direction of the central axis CL2, between a surface 82F of a noble metal tip 82 closest to the leading end face 27F of the ground electrode 27 along the central axis CL2 of the ground electrode 27 and a surface 82B farthest away from the leading end face 27F.

(f) In the heretofore described embodiment, the center electrode 5 includes the noble metal portion 31, but the noble metal portion 31 does not have to be provided.

(g) In the heretofore described embodiment, the ground electrode 27 is configured as a multi-layer structure formed of the outer layer 27A and inner layer 27B, but it may be taken that the ground electrode is configured of a single alloy, and it may be taken that the ground electrode is configured as a multi-layer structure with three layers or more.

(h) In the heretofore described embodiment, a case is embodied in which the ground electrode 27 is joined to the leading end portion 26 of the metal shell 3, but the invention can also be applied to a case in which a ground electrode is formed in such a way as to cut out one portion of the metal shell (or one portion of a leading end fitting welded to the metal shell in advance) (for example, JP-A-2006-236906).

(i) In the heretofore described embodiment, the tool engagement portion 19 is formed into a hexagonal cross-sectional shape, but the shape of the tool engagement portion 19 is not limited to this kind of shape. The tool engagement portion 19 may be formed in, for example, a Bi-HEX (variant dodecagonal) shape [IS022977:2005(E)].

| [Description of Reference Numerals and Signs] | |
|---|---|
| 1 | Spark plug |
| 2 | Insulator (insulating body) |
| 3 | Metal shell |
| 4 | Axial hole |

-continued

| [Description of Reference Numerals and Signs] | |
|---|---|
| 5 | Center electrode |
| 27 | Ground electrode |
| 27S | Leading end side side surface (junction target surface) |
| 32 | Noble metal tip |
| 32B | Buried portion |
| 32W | Large width portion |
| 33 | Spark discharge gap (gap) |
| 35 | Melt portion |
| CL1 | Axis |
| CL2 | Central axis (of ground electrode) |
| CL3 | Central axis (of noble metal tip) |
| CS | Junction portion |
| CP | Center (of junction portion) |

The invention claimed is:

1. A spark plug characterized by including:

an insulating body having an axial hole passing therethrough in a direction of an axis;

a center electrode inserted in the axial hole;

a hollow cylindrical metal shell provided on the outer periphery of the insulating body;

a ground electrode disposed at the leading end portion of the metal shell; and a columnar noble metal tip, joined to the leading end portion of the ground electrode, of which one end portion forms a gap with the leading end portion of the center electrode, wherein a buried portion buried into the interior side of the ground electrode from a junction target surface which is a surface of the ground electrode on the side on which the noble metal tip is joined is provided in the other end portion of the noble metal tip, and in a section, perpendicular to a central axis of the ground electrode, which passes through a center of a junction portion of the ground electrode and another end face of the noble metal tip, a large width portion larger in width than the one end portion of the noble metal tip is formed in the buried portion, a region of the noble metal tip positioned between the junction target surface and a largest width region of the large width portion is formed into a shape such as to gradually increase in width from one end side toward the other end side of the noble metal tip, or a shape such as to have a region gradually increasing in width, and a region constant in width, from the one end side toward the other end side of the noble metal tip, a region, of either side surface connecting the one end face and other end face of the noble metal tip, from the large width portion to a point of intersection with an extended line wherein the external line of the junction target surface is extended to the noble metal tip side is covered with at least one of a melt portion wherein the noble metal tip and ground electrode melt together and a base material of the ground electrode, and wherein at least a portion of the region is covered by the melt portion, and when a thickness of the noble metal tip along a central axis of the noble metal tip is taken to be t1 (mm), and an amount of the noble metal tip buried from the junction target surface along the central axis of the noble metal tip is taken to be t2 (mm), $0.25 \leq t2/t1$ is satisfied;

characterized in that the noble metal tip is joined to the ground electrode by the melt portion wherein the noble metal tip and ground electrode melt together, and when seen from the one end face side of the noble metal tip, within a range, in a longitudinal direction of the ground electrode, corresponding to the junction portion of the ground electrode and the other end face of the noble metal tip, a length of the melt portion in the longitudinal direction of the ground electrode is equal to or larger than half a length of the junction portion in the longitudinal direction of the ground electrode;

characterized in that a portion of the noble metal tip protrudes from a leading end face of the ground electrode; and characterized in that, when straight lines passing through points of intersection (P1) and (P2) between extended lines (EL1) and (EL2), wherein the external line of the leading end side side surface (27S) is extended to the noble metal tip side, and two side surfaces (32S1) and (32S2) each connecting the one end portion and the other end portion of the noble metal tip and passing through the end portion in the width direction of the large width portion are taken to be (SL1) and (SL2), and angles, among angles formed by the straight lines (SL1) and (SL2) and the external line of the leading end side side surface (27S), formed on the side opposite to that of the noble metal tip are taken to be $\theta 1$ and $\theta 2$, a configuration is adopted such that each of $\theta 1$ and $\theta 2$ is less than 90°.

2. The spark plug according to claim 1, characterized in that in the heretofore described section, when a protrusion length of the large width portion, in a direction perpendicular to the central axis of the noble metal tip, positioned on one side surface side of the noble metal tip, with the point of intersection between one side surface of both side surfaces connecting the one end face and other end face of the noble metal tip and the extended line wherein the external line of the junction target surface is extended to the noble metal tip side as a reference, is taken to be $\alpha$ (mm), a protrusion length of the large width portion, in a direction perpendicular to the central axis of the noble metal tip, positioned on the other side surface side of the noble metal tip, with the point of intersection between the other side surface of the noble metal tip and the extended line wherein the external line of the junction target surface is extended to the noble metal tip side as a reference, is taken to be $\beta$ (mm), the protrusion length $\alpha$ or protrusion length $\beta$, whichever is larger, is taken to be x (mm), and the width of a largest width region of the large width portion in a direction perpendicular to the central axis of the noble metal tip is taken to be W1 (mm), $x \geq W1 \times 0.02$ is satisfied.

3. The spark plug according to claim 1, characterized in that in the heretofore described section, the melt portion is formed thrusting into the interior side of the ground electrode from the junction target surface, and when a distance along the central axis of the noble metal tip from the junction target surface to a region of the melt portion thrusting deepest into the interior side of the ground electrode is taken to be d1 (mm), $d1 \geq 0.06$ is satisfied.

4. The spark plug according to claim 3, characterized in that in the heretofore described section, when a largest width, in a direction perpendicular to the central axis of the noble metal tip, of a region of the melt portion thrusting into the interior side of the ground electrode from the junction target surface is taken to be Y (mm), $0.17 \leq Y \leq 0.27$ is satisfied.

5. The spark plug according to claim 3, characterized in that in the heretofore described section, when a largest protrusion length of the melt portion from the junction target surface along the central axis of the noble metal tip is taken to be d3 (mm), $d3 \leq t1 - t2$ is satisfied.

6. The spark plug according to claim 1, characterized in that the noble metal tip is joined to the ground electrode by the melt portion wherein the noble metal tip and ground electrode melt together, and in the heretofore described section, the melt portion is in contact with at least one side surface of the two side surfaces connecting the one end face and other end face of the noble metal tip and the ground electrode positioned on the one side surface side.

7. The spark plug according to claim 1, characterized in that the noble metal tip is joined to the ground electrode by the melt portion wherein the noble metal tip and ground electrode melt together, and in the heretofore described section, the melt portion, as well as being in contact with one side surface of the noble metal tip and the ground electrode positioned on the one side surface side, is in contact with the other side surface of the noble metal tip and the ground electrode positioned on the other side surface side.

8. The spark plug according to claim 7, characterized in that in the heretofore described section, when a distance, along the central axis of the noble metal tip, of a region of the melt portion in contact with one side surface of the noble metal tip, or a distance, along the central axis of the noble metal tip, of a region of the melt portion in contact with the other side surface of the noble metal tip, whichever is larger, is taken to be d2 (mm), $d2 \geq 0.20$ is satisfied.

9. The spark plug according to claim 1, characterized in that in the heretofore described section, the other end face of the noble metal tip is formed into a curved shape convex toward the interior side of the ground electrode.

10. The spark plug according to claim 1, characterized in that $t2/t1 \leq 0.70$ is satisfied.

11. A method of manufacturing the spark plug according to claim 1, characterized by including:

a junction step of joining the noble metal tip to the ground electrode, wherein in the junction step, after the noble metal tip with a rectangular cross-sectional shape in a section including the central axis thereof is placed on the ground electrode, the noble metal tip is joined to the ground electrode while the buried portion buried into the ground electrode and the large width portion larger in width than the one end portion of the noble metal tip are being formed in the noble metal tip by the noble metal tip being energized while being pressed to the ground electrode side.

12. The spark plug according to claim 1, characterized in that the melt portion is in contact with at least one side surface, of the two side surfaces of the noble metal tip, and in contact with the ground electrode positioned on the one side surface side, and in contact with the junction target surface positioned on the one side surface side.

* * * * *